US011125048B1

(12) United States Patent
Giroux et al.

(10) Patent No.: US 11,125,048 B1
(45) Date of Patent: Sep. 21, 2021

(54) STAGE CEMENTING SYSTEM

(71) Applicant: Weatherford Technology Holdings, LLC, Houston, TX (US)

(72) Inventors: Richard Lee Giroux, Bellville, TX (US); Jeffery Morrison, Missouri City, TX (US); Jobby T. Jacob, Sugar Land, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/888,318

(22) Filed: May 29, 2020

(51) Int. Cl.
*E21B 33/14* (2006.01)
*E21B 34/10* (2006.01)

(52) U.S. Cl.
CPC ..... *E21B 33/146* (2013.01); *E21B 34/108* (2013.01); *E21B 2200/01* (2020.05); *E21B 2200/06* (2020.05)

(58) Field of Classification Search
CPC ..... E21B 33/146; E21B 34/14; E21B 33/14; E21B 34/10
See application file for complete search history.

(56) References Cited

U.S. PATENT DOCUMENTS 3,768,562 A 10/1973 Baker
3,948,322 A 4/1976 Baker
4,042,014 A 8/1977 Scott
4,105,069 A 8/1978 Baker
4,286,658 A 9/1981 Baker et al.
4,299,397 A 11/1981 Baker et al.
4,334,582 A 6/1982 Baker et al.
4,450,912 A * 5/1984 Callihan ..... E21B 33/16 166/289
4,703,813 A 11/1987 Sieler
5,137,087 A 8/1992 Szarka et al.
5,279,370 A 1/1994 Brandell et al.
5,299,640 A 4/1994 Streich et al.
7,798,225 B2 9/2010 Giroux et al.
7,857,052 B2 12/2010 Giroux et al.
8,042,616 B2 10/2011 Giroux et al.
8,066,069 B2 11/2011 Giroux et al.
9,316,091 B2 4/2016 Symms
9,328,579 B2 5/2016 Wilson
9,382,769 B2 7/2016 Wilson et al.
9,856,714 B2 1/2018 Giroux
2002/0174986 A1* 11/2002 Szarka ..... E21B 33/146 166/289

(Continued)

*Primary Examiner* — Zakiya W Bates
(74) *Attorney, Agent, or Firm* — Patterson + Sheridan, LLP

(57) ABSTRACT

A stage cementing system includes a stage cementing assembly having a stage tool. The stage tool has an outer mandrel, an inner mandrel coupled to and disposed inside of the outer mandrel, an annular chamber between the outer mandrel and the inner mandrel, a first outer port through the outer mandrel, and longitudinally spaced first and second inner ports through the inner mandrel. The stage cementing system further includes an inner string assembly configured to be located inside the inner mandrel. The inner string assembly has a tubular body having a central throughbore and longitudinally spaced first and second side ports, a lower external seal element below the first and second side ports, a middle external seal element between the first and second side ports, and an upper external seal element above the first and second side ports.

19 Claims, 17 Drawing Sheets

(56) References Cited

U.S. PATENT DOCUMENTS

2015/0159466 A1* 6/2015 Themig ..... E21B 34/14
166/285
2017/0145784 A1* 5/2017 Zhou ..... E21B 33/128

* cited by examiner

STAGE CEMENTING SYSTEM

BACKGROUND

Field

Embodiments of the present disclosure generally relate to systems, tools, and methods for performing cementing operations in a wellbore to secure wellbore casing or lining tubulars in place.

Description of the Related Art

Typically, when a borehole is drilled, at least a portion of the wellbore is lined with tubulars, commonly referred to as casing and liners. The term "casing" is used herein to refer to any such tubulars. The casing has an outer diameter that is smaller than the diameter of the borehole, and so there exists an annulus between the borehole and the casing. Usually, this annulus is at least partially filled with cement, which secures the casing in place and serves as a barrier to impede the migration of fluids within this annulus. Sometimes, cement is also placed in an annulus between concentric casing tubulars. Placement of cement into such annuli usually involves the pumping of a cement slurry that is then left to cure. Various tools may be used to facilitate the placement of the cement slurry. One such tool is a "stage tool" that is utilized as part of a string of joined-together casing tubulars. Stage tools typically are generally tubular in form, and have a port in a sidewall through which a cement slurry may be pumped into the annulus surrounding the string of casing. Such tools normally have an internal and/or external sleeve that may be manipulated to cover the port after the cement slurry has been pumped. Such tools usually form part of stage cementing systems that include additional tools that are used during the cementing operations.

SUMMARY

In one embodiment, a stage cementing system includes a stage cementing assembly having a stage tool. The stage tool has an outer mandrel, an inner mandrel coupled to and disposed inside of the outer mandrel, an annular chamber between the outer mandrel and the inner mandrel, a first outer port through the outer mandrel, and longitudinally spaced first and second inner ports through the inner mandrel. The stage cementing system further includes an inner string assembly configured to be located inside the inner mandrel. The inner string assembly has a tubular body having a central throughbore and longitudinally spaced first and second side ports, a lower external seal element below the first and second side ports, a middle external seal element between the first and second side ports, and an upper external seal element above the first and second side ports.

In another embodiment, a stage cementing assembly includes a stage tool having an outer mandrel, an inner mandrel immovably disposed inside and coupled to the outer mandrel, an annular chamber between the outer mandrel and the inner mandrel, a first outer port through the outer mandrel, longitudinally spaced first and second inner ports through the inner mandrel, and a closing sleeve disposed in the annular chamber. The closing sleeve is movable between a first position in which the closing sleeve permits fluid communication between an interior of the stage cementing assembly and an exterior of the stage cementing assembly through the first inner port and the first outer port, and a second position in which the closing sleeve prevents fluid communication between the interior of the stage cementing assembly and the exterior of the stage cementing assembly through the first inner port and the first outer port. The closing sleeve prevents fluid communication between the interior of the stage cementing assembly and the exterior of the stage cementing assembly through the second inner port and the first outer port when the sleeve is in both the first and the second positions. The inner mandrel does not have an internal movable sleeve.

In another embodiment, a stage tool includes an outer mandrel, an inner mandrel immovably disposed inside and coupled to the outer mandrel, an annular chamber between the outer mandrel and the inner mandrel, a first outer port through the outer mandrel, a second outer port through the outer mandrel, the second outer port having a relief valve, longitudinally spaced first and second inner ports through the inner mandrel, and a barrier member. The barrier member has a first configuration in which the barrier member prevents fluid communication between an interior of the stage tool and an exterior of the stage tool through the first outer port, and a second configuration in which the barrier member permits fluid communication between the interior of the stage tool and the exterior of the stage tool through the first outer port. The stage tool further includes a closing sleeve disposed in the annular chamber. The closing sleeve is movable between a first position in which the closing sleeve permits fluid communication between the interior of the stage tool and the exterior of the stage tool through the first inner port and the first outer port, and a second position in which the closing sleeve prevents fluid communication between the interior of the stage tool and the exterior of the stage tool through the first inner port and the first outer port. The closing sleeve prevents fluid communication between the interior of the stage tool and the exterior of the stage tool through the second inner port and the first outer port when the sleeve is in both the first and the second positions.

In another embodiment, a tool for use in cementing a casing includes a tubular body having a central throughbore and longitudinally spaced first and second side ports, a lower external seal element below the first and second side ports, a middle external seal element between the first and second side ports, and an upper external seal element above the first and second side ports.

In another embodiment, there is provided a method of cementing a casing string that includes a stage tool. The method involves opening a first side port of an inner string located inside the casing string, pumping a cementing fluid through the first side port into a first annular space between the inner string and the casing string, through a first inner port of an inner mandrel of the stage tool, and through a first outer port of an outer mandrel of the stage tool. The method further involves opening a second side port of the inner string, applying a hydraulic pressure through the second side port into a second annular space between the inner string and the casing string, and through a second inner port of the inner mandrel of the stage tool, thereby moving a closing sleeve of the stage tool to a position preventing fluid flow through the first outer port.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns tools and methods for performing cementing operations in a wellbore.

Figure 1:
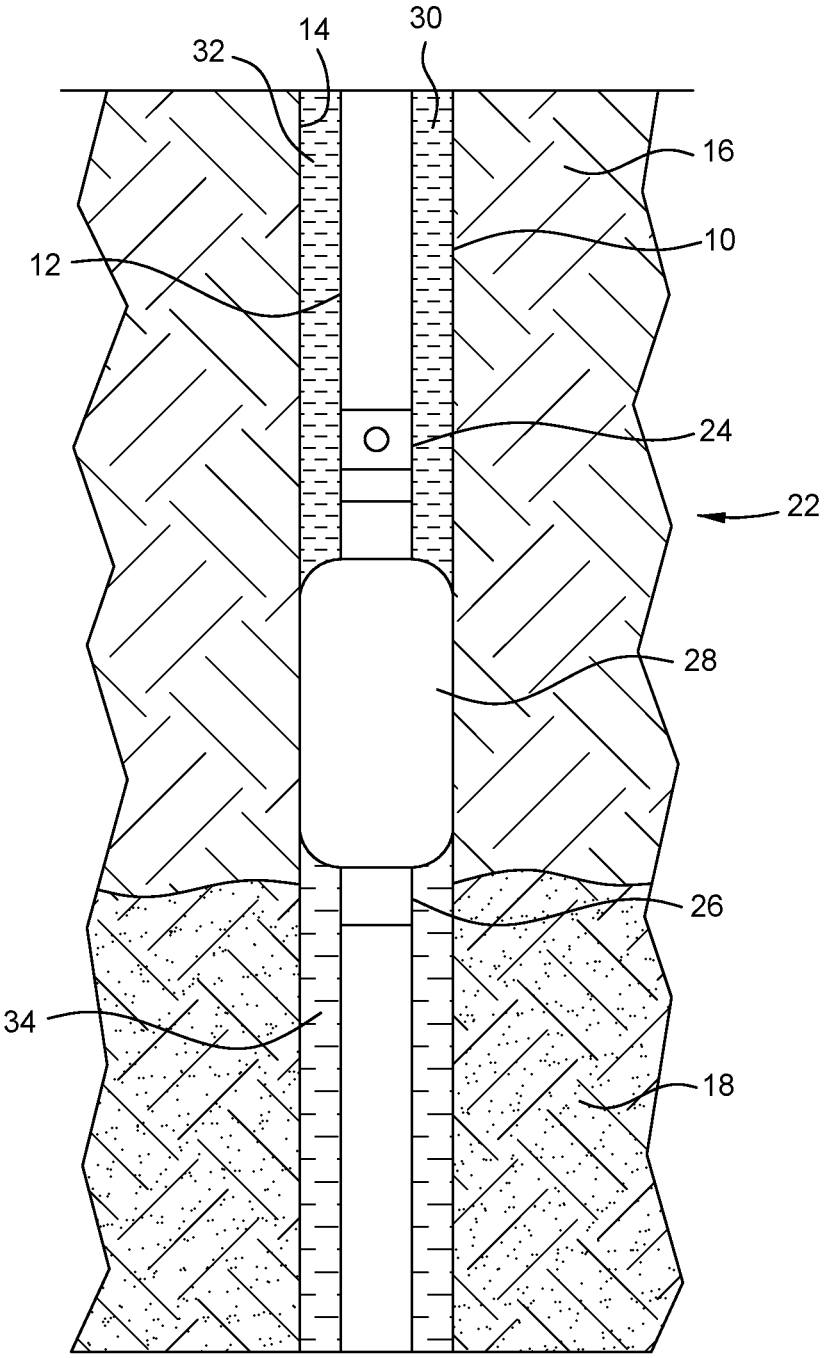
FIG. 1 shows a borehole that is lined with a casing having a stage tool.

FIG. 1 is a general view of a portion of a wellbore 10. The wellbore 10 is depicted as being vertical, but it is within the scope of this disclosure for the wellbore 10 to have at least one section that is oriented at an angle with respect to vertical. The at least one section may be curved. The at least one section may be horizontal. The portion of a wall 14 of the wellbore 10 shown in FIG. 1 may be defined by exposed faces of geological formations 16 and 18. Additionally, or alternatively, the portion of the wellbore wall 14 shown in FIG. 1 may be defined by a previously-installed casing. The wellbore 10 is lined with a casing 12 that includes a stage cementing assembly 22. The stage cementing assembly 22 includes a stage tool 24. The stage cementing assembly 22 may also include a packer 26. The packer 26 may include a packer seal 28 that may be deformed into contact with the wall 14 of the wellbore 10, thereby substantially filling a portion of the annulus 30 between the casing 12 and the wellbore 10 and separating the annulus 30 into upper and lower annulus sections 32 and 34, respectively. The lower annulus section 34 may contain a fluid, such as drilling fluid, seawater, brine, indigenous formation fluid (such as water, oil, condensate, gas, etc.), cement, or any other fluid. At least a portion of the upper annulus section 32 may contain cement that has been pumped into the upper annulus section 32 according to the methods described herein.

Figure 2:
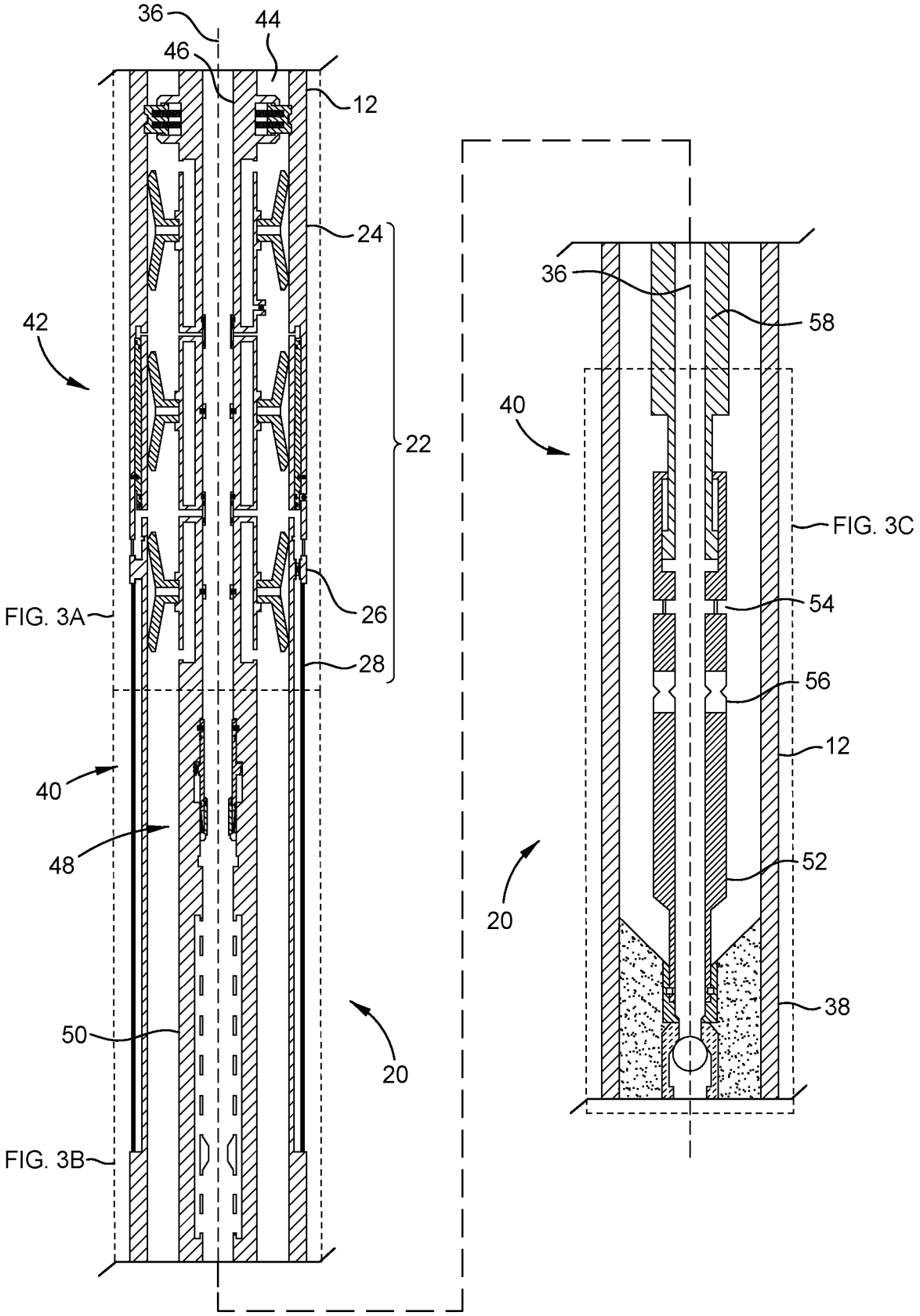
FIG. 2 shows an overview of a stage cementing system of the present disclosure.

FIGS. 2 to 3C and 5 to 15 are depicted as half longitudinal cross-sections, each longitudinal cross-section having a centerline 36. FIG. 2 shows an overview of a stage cementing system 20 of the present disclosure assembled as part of a string of casing 12. The casing 12 may have a collar 38. The collar 38 may be a plug landing collar. The collar 38 may be a float device. The float device may be a float collar. The float device may be a float shoe. FIG. 2 shows the stage cementing system 20 split (for ease of viewing) into an upper section and a lower section.

The stage cementing system 20 may include a stage cementing assembly 22. The stage cementing assembly 22 may include a stage tool 24 coupled to the casing 12. The stage cementing assembly 22 may include a packer 26 coupled to the casing 12. The packer 26 may be connected to, or part of, the stage tool 24. The stage cementing system 20 may also include an inner string assembly 40. The inner string assembly 40 may include a seal section 42 that seals one or more portions of the annular space 44 between the inner string assembly 40 and the stage cementing assembly 22. The inner string assembly 40 may include a locator 46 to provide for an appropriate juxtaposition between the seal section 42 and the stage tool 24. The inner string assembly 40 may include a time-delay releasable seat assembly 48 below the seal section 42 to facilitate the pressure testing of the stage tool 24 at the end of a cementing operation. The inner string assembly 40 may include a catcher 50 below the time-delay releasable seat assembly 48. The inner string may further include a stinger 52, a circulation port 54, a separable member 56, and one or more axial slip joints 58.

Figure 3A:
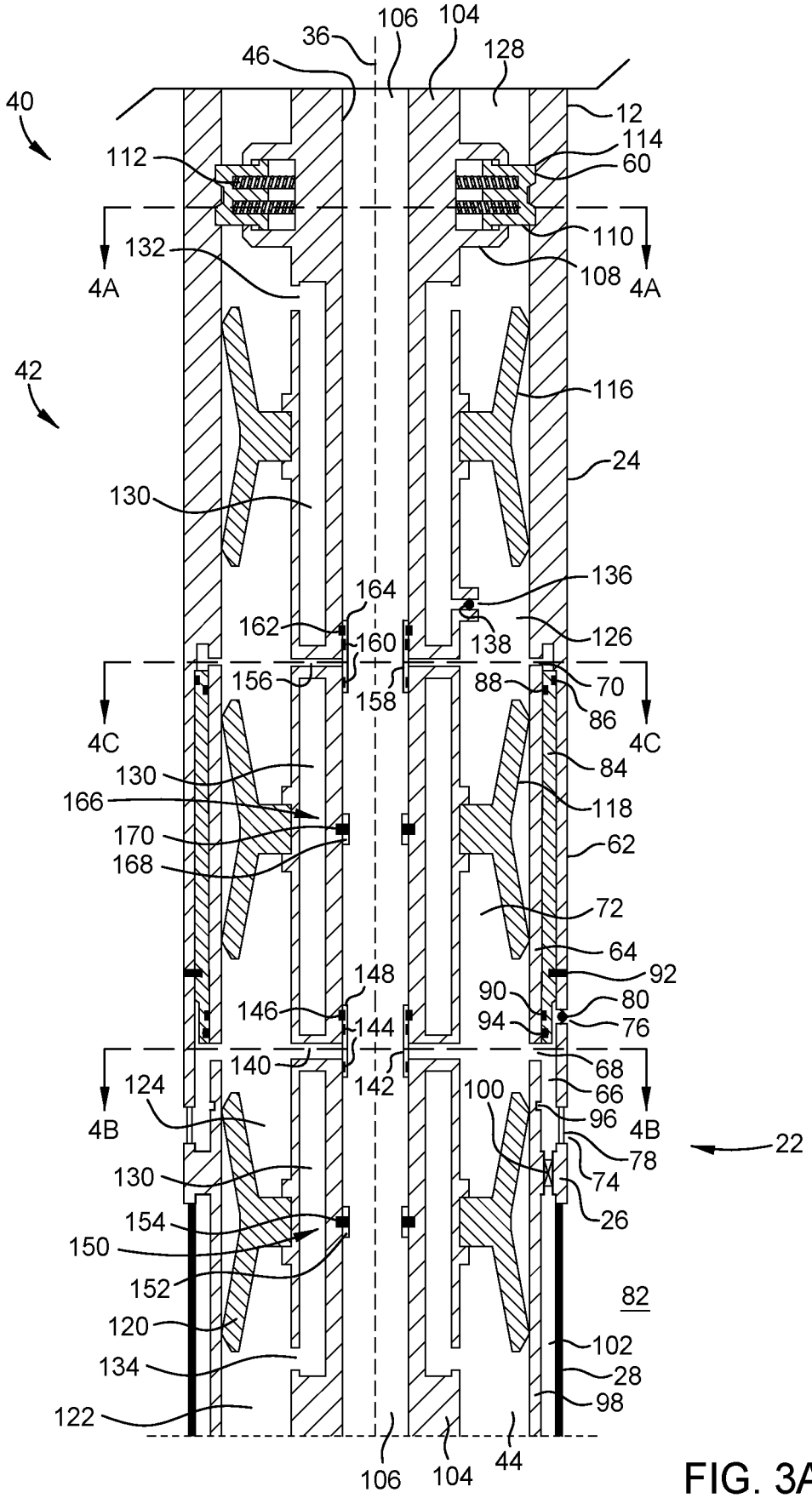
FIG. 3A shows the top part of an upper section of the stage cementing system of FIG. 2 in greater detail.

FIG. 3A shows the top part of an upper section of the stage cementing system 20 of FIG. 2 in greater detail. The stage cementing system 20 may include a stage cementing assembly 22. The stage cementing assembly 22 may include a stage tool 24 coupled to the casing 12. In some embodiments, the stage cementing assembly 22 may include an internal location profile 60. In some embodiments, a joint of casing associated with the stage cementing assembly 22 may include an internal location profile 60. In some embodiments, the stage tool 24 may include an internal location profile 60. The stage tool 24 may have an outer mandrel 62 and an inner mandrel 64 coupled to and disposed within the outer mandrel 62. The inner mandrel 64 may be immovable with respect to the outer mandrel 62. An annular chamber 66 may exist between the outer and inner mandrels 62, 64. The inner mandrel 64 may have first and second inner ports (68, 70), each inner port 68, 70 providing for a fluidic connection between an interior 72 of the stage cementing assembly 22 and the annular chamber 66. The first inner port 68 may be spaced longitudinally from the second inner port 70.

In some embodiments, there is no movable sleeve internal to the inner mandrel 64. In other embodiments, the inner mandrel 64 may have a movable sleeve internal to the inner mandrel 64.

The outer mandrel 62 may have a first outer port 74 providing for a fluidic connection between the annular chamber 66 and an exterior 82 of the stage cementing assembly 22. In some embodiments, during installation of the stage tool 24 in the wellbore 10, the first outer port 74 may be open to fluid transfer between the annular chamber 66 and the exterior 82 of the stage cementing assembly 22. In some embodiments, during installation of the stage tool 24 in the wellbore 10, the first outer port 74 may be closed to fluid transfer between the annular chamber 66 and the exterior 82 of the stage cementing assembly 22 by a barrier member 78. In some embodiments, the barrier member 78 may be a rupture disk that may be defeated by hydraulic pressure in order to open fluid communication through the first outer port 74. In another embodiment, the barrier member 78 may be a sleeve (not shown) external to the outer mandrel 62, the sleeve being movable by hydraulic pressure or a mechanical force to open fluid communication through the first outer port 74.

In some embodiments, the outer mandrel 62 may have a second outer port 76 providing for a fluidic connection between the annular chamber 66 and an exterior 82 of the stage cementing assembly 22. In some embodiments, the second outer port 76 may have a relief valve 80, such as a check valve. The relief valve 80 may permit fluid exterior to the outer mandrel 62 to enter the annular chamber 66, but prevent fluid in the annular chamber 66 from exiting the stage tool 24 to the exterior. In another embodiment, the first outer port 74 may be open to fluid transfer between the annular chamber 66 and the exterior during installation of the stage tool 24 in the wellbore 10, and the second outer port 76 may be absent or omitted. In another embodiment, the first outer port 74 may be open to fluid transfer between the annular chamber 66 and the exterior during installation of the stage tool 24 in the wellbore 10, and the second outer port 76 may be present and open to fluid transfer between the annular chamber 66 and the exterior during installation of the stage tool 24 in the wellbore 10. In another embodiment, the first outer port 74 may be open to fluid transfer between the annular chamber 66 and the exterior during installation of the stage tool 24 in the wellbore 10, and the second outer port 76 may be present but plugged closed to fluid transfer between the annular chamber 66 and the exterior during installation of the stage tool 24 in the wellbore 10.

A closing sleeve 84 may be disposed concentrically between the outer mandrel 62 and the inner mandrel 64 within the annular chamber 66. The closing sleeve 84 may divide the annular chamber 66 into upper and lower portions. The closing sleeve 84 may have seals that prevent fluid communication through an interface between the closing sleeve 84 and the outer mandrel 62 and/or prevent fluid communication through an interface between the closing sleeve 84 and the inner mandrel 64. In some embodiments, a first seal 86 prevents fluid communication through an interface between the closing sleeve 84 and the outer mandrel 62 and a second seal 88 prevents fluid communication through an interface between the closing sleeve 84 and the inner mandrel 64. In some embodiments, a third seal 90 prevents fluid communication through an interface between the closing sleeve 84 and the inner mandrel 64.

The closing sleeve 84 may be movable between first and second positions. In the first position, the closing sleeve 84 may permit fluid communication between the interior 72 of the stage cementing assembly 22 and the exterior 82 of the stage cementing assembly 22 through the first inner port 68 and the first outer port 74. In the first position, the closing sleeve 84 may prevent fluid communication between the interior 72 of the stage cementing assembly 22 and the exterior 82 of the stage cementing assembly 22 through the second inner port 70 and the first outer port 74 because of the first seal 86 and the second seal 88. In the second position, the closing sleeve 84 may prevent fluid communication between the interior 72 of the stage cementing assembly 22 and the exterior 82 of the stage cementing assembly 22 through the first inner port 68 and the first outer port 74 because of the first seal 86, the second seal 88, and the third seal 90. In the second position, the closing sleeve 84 may prevent fluid communication between the interior 72 of the stage cementing assembly 22 and the exterior 82 of the stage cementing assembly 22 through the second inner port 70 and the first outer port 74 because of the first seal 86 and the second seal 88.

The closing sleeve 84 may be temporarily restrained from moving from the first position to the second position. In some embodiments, the closing sleeve 84 may be temporarily held in the first position by a retaining member 92. The retaining member 92 may include a frangible member, such as a shear pin, shear screw, or shear ring. In some embodiments, the retaining member 92 may include a snap ring engaged with a detent or a collet. In some embodiments, the retaining member 92 may temporarily couple the closing sleeve 84 to the outer mandrel 62. In other embodiments, the closing sleeve 84 may be temporarily held in the first position by a biasing member (such as a spring). In other embodiments, the closing sleeve 84 may be temporarily held in the first position by a combination of any of a retaining member 92 and a biasing member.

Once in the second position, the closing sleeve 84 may be restrained from moving from the second position to the first position. In some embodiments, the closing sleeve 84 may have a snap ring 94. The snap ring 94 may be configured to mate with a detent 96 on an outer surface of the inner mandrel 64. Alternatively, the snap ring 94 may be configured to mate with a detent on an inner surface of the outer mandrel 62. In other embodiments, the closing sleeve 84 may be restrained from moving from the second position to the first position by a latch member, such as a locking dog.

Still with FIG. 3A, in some embodiments, the stage cementing assembly 22 of the stage cementing system 20 may include a packer 26 located below the first outer port 74 of the stage tool 24. The packer 26 may include a packer mandrel 98 and a packer seal 28 circumferentially surrounding at least a portion of the packer mandrel 98. The packer seal 28 may be deformed into contact with the wall 14 of the wellbore 10, thereby substantially filling a portion of the annulus 30 between the casing 12 and the wellbore 10 and separating the annulus 30 into upper and lower annulus sections (32 and 34, respectively, see FIG. 1). The packer 26 may be part of the stage tool 24. Alternatively, the packer 26 may be coupled to the stage tool 24. In some embodiments, the packer seal 28 may include a bladder that may be inflated by pressurized fluid. In some embodiments, the packer seal 28 may be deformed radially as a result of being subjected to axial compression.

In some embodiments, the packer 26 may be actuated by fluid passing through a valve assembly 100. The valve assembly 100 may regulate fluid transfer into the packer 26. The valve assembly 100 may regulate fluid transfer out of the packer 26. The valve assembly 100 may be located so as to regulate fluid transfer between the interior 72 of the stage cementing assembly 22 and an internal chamber 102 of the packer 26. In some embodiments, as illustrated in FIG. 3A, fluid transfer between the interior 72 of the stage cementing assembly 22 and the internal chamber 102 of the packer 26 may be via the annular chamber 66 of the stage tool 24, and the valve assembly 100 may regulate fluid transfer between the annular chamber 66 of the stage tool 24 and the internal chamber 102 of the packer 26.

The valve assembly 100 may prevent fluid transfer from the interior 72 of the stage cementing assembly 22 to the internal chamber 102 of the packer 26 until a pressure of the fluid in the interior 72 of the stage cementing assembly 22 exceeds a pressure of the fluid in the internal chamber 102 of the packer 26 by a first threshold magnitude. Upon the pressure of the fluid in the interior 72 of the stage cementing assembly 22 exceeding the pressure of the fluid in the internal chamber 102 of the packer 26 by the first threshold magnitude, the valve system may operate to permit fluid in the interior 72 of the stage cementing assembly 22 to enter the internal chamber 102 of the packer 26. The valve assembly 100 may permit fluid transfer from the interior 72 of the stage cementing assembly 22 to the internal chamber 102 of the packer 26 until a pressure of the fluid in the internal chamber 102 of the packer 26 exceeds a pressure of the fluid exterior 82 of the stage cementing assembly 22 by a second threshold magnitude. Upon the pressure of the fluid in the internal chamber 102 of the packer 26 exceeding the pressure of the fluid exterior 82 of the stage cementing assembly 22 by the second threshold magnitude, the valve system may operate to prevent fluid in the interior 72 of the stage cementing assembly 22 from entering the internal chamber 102 of the packer 26. The valve system may prevent fluid from exiting the internal chamber 102 of the packer 26.

In some embodiments, the stage cementing assembly 22 includes a stage tool 24 having an outer mandrel 62 with a first outer port 74 that provides fluid communication between the interior 72 of the stage cementing assembly 22 and an exterior 82 of the stage cementing assembly 22, and the stage cementing assembly 22 further includes a packer 26 having a valve assembly 100 that selectively enables fluid transfer between the interior 72 of the stage cementing assembly 22 and an internal chamber 102 of the packer 26. In such embodiments, the first outer port 74 may be initially closed to fluid transfer between the interior 72 of the stage cementing assembly 22 and the exterior 82 of the stage cementing assembly 22 by a barrier member 78, as described above. The valve assembly 100 may first permit fluid transfer from the interior 72 of the stage cementing assembly 22 into the internal chamber 102 of the packer 26 while the first outer port 74 is closed to fluid transfer. In some embodiments, the valve assembly 100 may then prevent fluid transfer from the interior 72 of the stage cementing assembly 22 into the internal chamber 102 of the packer 26 while the first outer port 74 is closed to fluid transfer. Alternatively, in some embodiments, the valve assembly 100 may then prevent fluid transfer from the interior 72 of the stage cementing assembly 22 into the internal chamber 102 of the packer 26 while the first outer port 74 is opening to fluid transfer. Alternatively, in some embodiments, the valve assembly 100 may then prevent fluid transfer from the interior 72 of the stage cementing assembly 22 into the internal chamber 102 of the packer 26 after the first outer port 74 is opened to fluid transfer.

In some embodiments, operation of the packer 26 may not involve a valve assembly and threshold pressure differentials. For example, the packer 26 may include a seal element that is configured to swell in size upon exposure to a specific type of fluid, such as a hydrocarbon or an aqueous fluid. In some embodiments, the packer 26 may include such a swellable seal element in addition to a valve assembly 100.

In some embodiments, the packer 26 may be omitted. The first outer port 74 of the outer mandrel 62 of the stage tool 24 may be open to fluid transfer between the annular chamber 66 and the exterior 82 of the stage cementing assembly 22 during installation of the stage tool 24 in the wellbore 10. In such an embodiment, the second outer port 76 of the outer mandrel 62 of the stage tool 24 may be omitted. Alternatively, the second outer port 76 of the outer mandrel 62 of the stage tool 24 may be present.

The stage cementing system 20 further includes an inner string assembly 40. The inner string assembly 40 may be coupled to a workstring, such as drill pipe, coiled tubing, or other tubulars, that extends from a drilling rig to the inner string assembly 40. The inner string assembly 40 may include a tubular body 104 having a central throughbore 106. The tubular body 104 may include a plurality of tubular components coupled together. Individual tubular components of the plurality of tubular components may be associated with different tools and/or different portions of the inner string assembly 40.

Figure 4A:
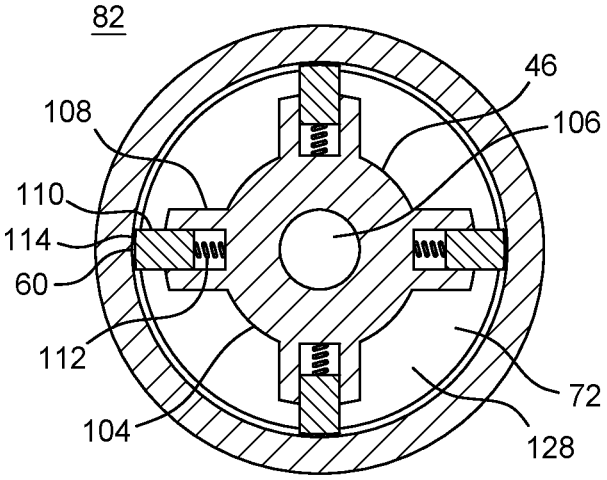
FIGS. 4A-C show lateral cross-sections of the upper section of the stage cementing system of FIG. 3A.

The inner string assembly 40 may include a locator 46. The locator 46 may have one or more locator dog housings 108 on the tubular body 104, with each locator dog housing 108 having a locator dog member 110. In one embodiment, as shown in FIG. 4A, the locator 46 may have a plurality of locator dog housings 108 arranged circumferentially around the tubular body 104. In some embodiments, the locator dog member(s) 110 may be movable with respect to the respective locator dog housing 108 between radially retracted and radially extended positions. In one embodiment, the locator dog members 110 may be movable between radially retracted and radially extended positions upon the application of a hydraulic pressure in the central throughbore 106 of the tubular body 104. In some embodiments, the locator dog members 110 may be movable between radially retracted and radially extended positions by a force exerted by a biasing member 112, such as a spring. The locator dog members 110 may have an outer profile 114 that is complementary with the internal location profile 60.

The inner string assembly 40 may further have a seal section 42. In some embodiments, the seal section 42 may have upper, middle, and lower seal elements (116, 118, and 120, respectively) that extend circumferentially around an outer surface of the tubular body 104. Each seal element 116, 118, 120 may be configured to contact and seal against an inner surface of the stage cementing assembly 22. The upper seal element 116 may be longitudinally separated from the middle seal element 118, which may be longitudinally separated from the lower seal element 120. Hence, the annular space 44 between the stage cementing assembly 22 and the inner string assembly 40 may be separated into a first annular compartment 122 below the lower seal element 120, a second annular compartment 124 between the lower seal element 120 and the middle seal element 118, a third annular compartment 126 between the middle seal element 118 and the upper seal element 116, and a fourth annular compartment 128 above the upper seal element 116. In use, the inner string may be positioned within the stage cementing assembly 22 such that when the locator dog member 110 is engaged with the internal location profile 60, the upper seal element 116 is located above the second inner port 70 (and hence also above the first inner port 68) of the inner mandrel 64 of the stage tool 24; the middle seal element 118 may be located between the first inner port 68 and the second inner port 70 of the inner mandrel 64 of the stage tool 24; and the lower seal element 120 may be positioned below the first inner port 68 (and hence also below the second inner port 70) of the inner mandrel 64 of the stage tool 24.

Figure 4B:
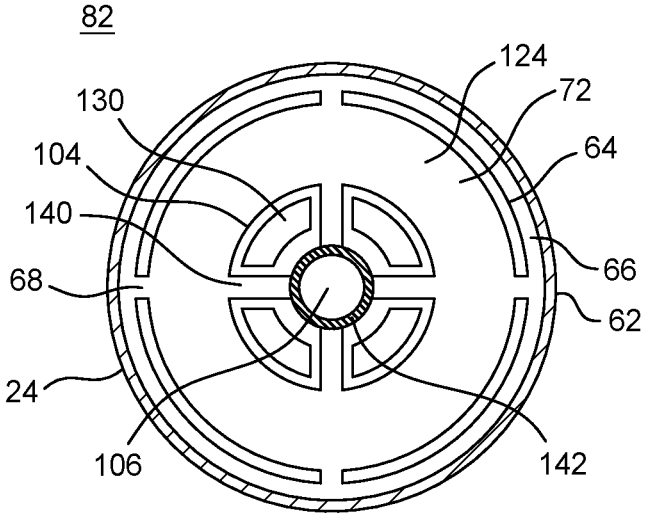
Figure 4C:
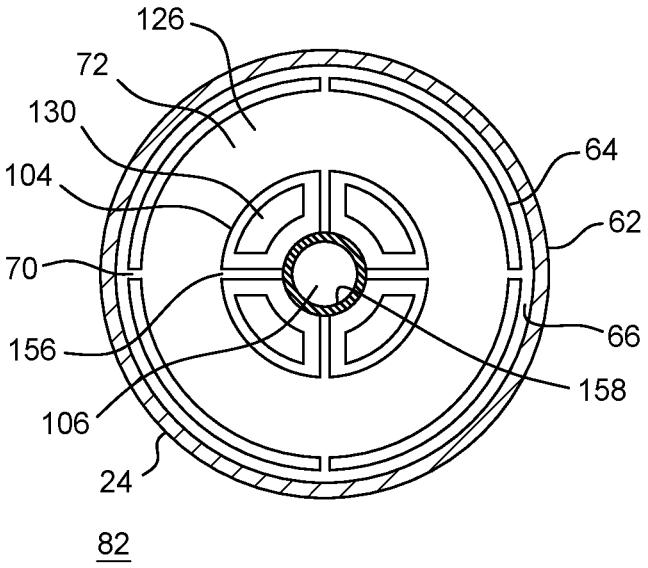

As shown in FIGS. 3A, 4B, and 4C, in some embodiments, the inner string may have a bypass 130 that fluidly connects the first annular compartment 122 and fourth annular compartment 128. The bypass 130 may include an upper bypass port 132 above the upper seal element 116, and may also include a lower bypass port 134 below the lower seal element 120. Thus, fluid may transfer between the first annular compartment 122 and fourth annular compartment 128. In some embodiments, the inner string may have a relief port 136. The relief port 136 may provide for a fluid connection between the bypass 130 and the third annular compartment 126. The relief port 136 may have a relief valve 138, such as a check valve. The relief valve 138 may permit fluid flow from the bypass 130 into the third annular compartment 126, and prevent fluid flow from the third annular compartment 126 into the bypass 130.

As shown in FIGS. 3A and 4B, in some embodiments, the inner string may have a first side port 140 that may provide for a fluid connection between the central throughbore 106 of the tubular body 104 and the second annular compartment 124. The inner string may also have a first sleeve 142 associated with the first side port 140. The first sleeve 142 may be positioned within the central throughbore 106 of the tubular body 104, and may be movable between a first position in which the first sleeve 142 prevents fluid communication through the first side port 140 and a second position in which the first sleeve 142 permits fluid communication through the first side port 140. The first sleeve 142 may have seals 144 that prevent fluid communication through the first side port 140 when the first sleeve 142 is in the first position. The first sleeve 142 may be temporarily retained in the first position by a retaining member 146, such as a shear pin, shear screw, shear ring, locking dog, or collet. The first sleeve 142 may include a seat 148 that is sized to receive an actuating object, such as a ball, plug, or dart. In use, a force applied to the first sleeve 142 by the actuating object may defeat the retaining member 146 and cause the first sleeve 142 to move from the first position to the second position, thereby permitting fluid communication between the central throughbore 106 of the tubular body 104 and the second annular compartment 124. The force may be applied by hydraulic pressure acting on the actuating object. In some embodiments, the first sleeve 142 moves downwardly from the first position to the second position. When the first sleeve 142 moves to the second position, the first sleeve 142 may approach and contact a first sleeve stop assembly 150. The first sleeve stop assembly 150 may include a first sleeve stop member 152 in the central throughbore 106 of the tubular body 104. The first sleeve stop member 152 may be retained in place by a retaining member 154, such as a shear pin, shear screw, shear ring, set screw, locking dog, or collet.

As shown in FIGS. 3A and 4C, in some embodiments, the inner string assembly 40 may have a second side port 156 that may provide for a fluid connection between the central throughbore 106 of the tubular body 104 and the third annular compartment 126. The second side port 156 may be longitudinally separated from the first side port 140. The inner string may also have a second sleeve 158 associated with the second side port 156. The second sleeve 158 may be positioned within the central throughbore 106 of the tubular body 104, and may be movable between a first position in which the second sleeve 158 prevents fluid communication through the second side port 156 and a second position in which the second sleeve 158 permits fluid communication through the second side port 156. The second sleeve 158 may have seals 160 that prevent fluid communication through the second side port 156 when the second sleeve 158 is in the first position. The second sleeve 158 may be temporarily retained in the first position by a retaining member 162, such as a shear pin, shear screw, shear ring, locking dog, or collet. The second sleeve 158 may include a seat 164 that is sized to receive an actuating object, such as a ball, plug, or dart. In use, a force applied to the second sleeve 158 by the actuating object may defeat the retaining member 162 and cause the second sleeve 158 to move from the first position to the second position, thereby permitting fluid communication between the central throughbore 106 of the tubular body 104 and the third annular compartment 126. The force may be applied by hydraulic pressure acting on the actuating object. In some embodiments, the second sleeve 158 moves downwardly from the first position to the second position. When the second sleeve 158 moves to the second position, the second sleeve 158 may approach and contact a second sleeve stop assembly 166. The second sleeve stop assembly 166 may include a second sleeve stop member 168 in the central throughbore 106 of the tubular body 104. The second sleeve stop member 168 may be retained in place by a retaining member 170, such as a shear pin, shear screw, shear ring, set screw, locking dog, or collet.

In some embodiments, at least a portion of the second annular compartment 124 may contain a filler material so as to limit the amount of cement or other substances that may accumulate in the second annular compartment 124. In some embodiments, the filler material may be a plastic material and/or an elastomeric material and/or a composite material. In some embodiments, the filler material may be arranged so as not to obscure the first inner port 68 of the stage tool 24. In some embodiments, the filler material may be arranged so as not to obscure the first side port 140 of the inner string assembly 40. In some embodiments, the filler material may be arranged so as to not to substantially hinder the passage of fluid and/or the application of hydraulic pressure between the first side port 140 of the inner string assembly 40 and the first inner port 68 of the stage tool 24.

In some embodiments, at least a portion of the third annular compartment 126 may contain a filler material so as to limit the amount of cement or other substances that may accumulate in the third annular compartment 126. In some embodiments, the filler material may be a plastic material and/or an elastomeric material and/or a composite material. In some embodiments, the filler material may be arranged so as not to obscure the second inner port 70 of the stage tool 24. In some embodiments, the filler material may be arranged so as not to obscure the second side port 156 of the inner string assembly 40. In some embodiments, the filler material may be arranged so as to not to substantially hinder the passage of fluid and/or the application of hydraulic pressure between the second side port 156 of the inner string assembly 40 and the second inner port 70 of the stage tool 24.

Figure 3B:
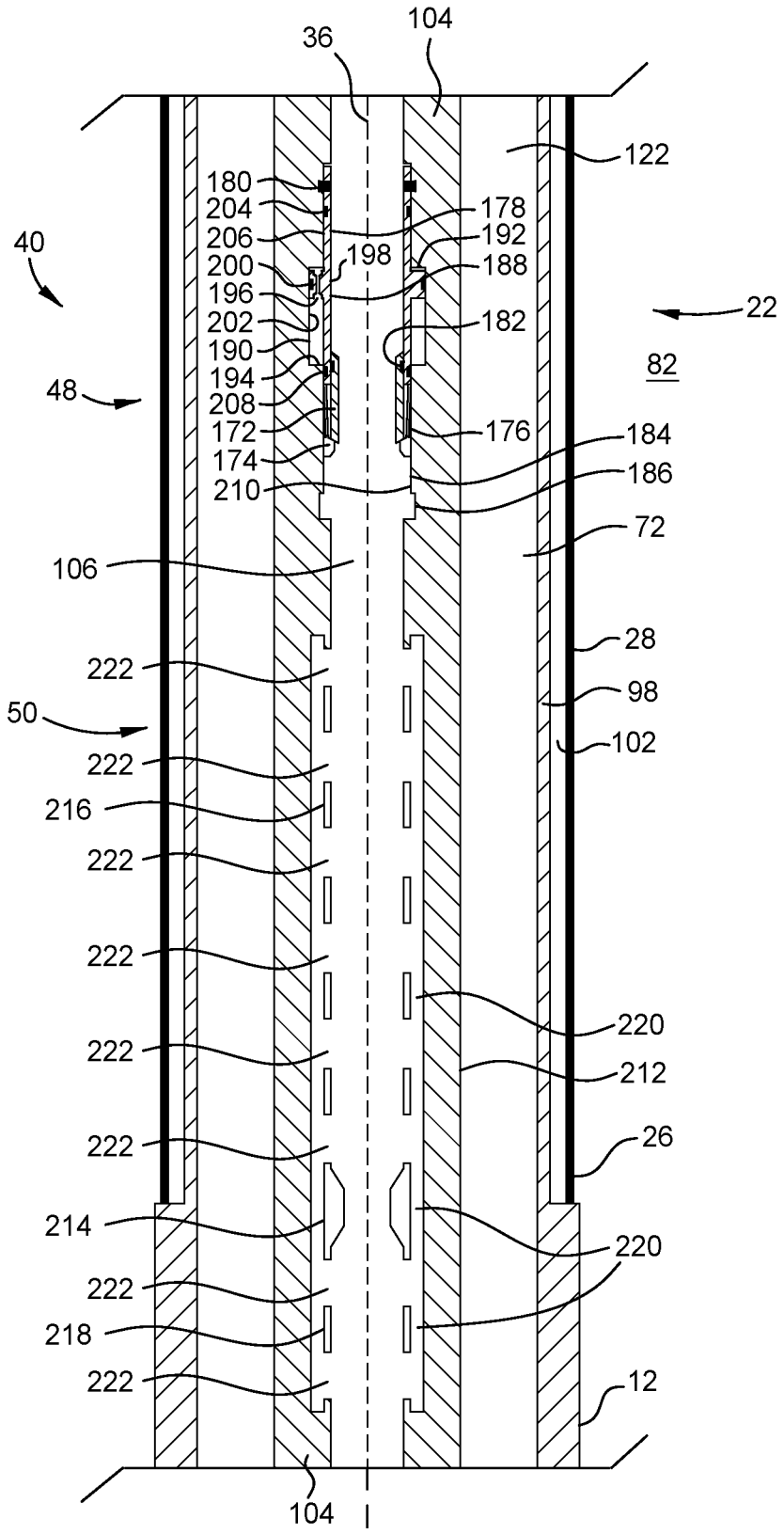
FIG. 3B shows the bottom part of the upper section of the stage cementing system of FIG. 2 in greater detail.

FIG. 3B is a continuation of FIG. 3A, and illustrates further aspects of some embodiments of the stage cementing system 20. In some embodiments, the inner string assembly 40 may include a time-delay releasable seat assembly 48. The time-delay releasable seat assembly 48 may have a seat 172. The seat 172 may be supported by collet dogs 174. The collet dogs 174 may be coupled to collet fingers 176 that are also coupled to a sleeve 178. The sleeve 178 may be axially movable from a first position to a second position. The sleeve 178 may be temporarily retained in the first position by a retaining member 180, such as a shear pin, shear screw, shear ring, locking dog, or collet. In some embodiments, the seat 172 may be supported by the collet dogs 174 and overlap a portion of the sleeve 178. The seat 172 may include a seal 182 in contact with the sleeve 178. The sleeve 178 may be housed within a first recess 184 in the central throughbore 106 of the tubular body 104. The time-delay releasable seat assembly 48 may include a second recess 186. The second recess 186 may be located within or proximate to the first recess 184. The second recess 186 may be sized so as to accommodate at least a portion of each of the collet dogs 174. In some embodiments, the second recess 186 may be sized so as to accommodate at least a portion of each of the collet dogs 174 to the extent that when the collet dogs 174 move into the second recess 186, the collet dogs 174 release the seat 172. When the collet dogs 174 release the seat 172, the seat 172 may become free to move axially with respect to the sleeve 178.

The sleeve 178 may have an outward radial projection 188 that extends circumferentially around the sleeve 178 and into a pocket 190 in the first recess 184. In some embodiments, axial movement of the sleeve 178 may be limited by the extent of axial movement of the outward radial projection 188 between upper and lower sides (192, 194, respectively) of the pocket 190. In some embodiments, the pocket 190 also contains a fluid. In a further embodiment, the fluid may be relatively viscous. In some embodiments, the outward radial projection 188 has a fluid transfer bore 196 that fluidly connects a portion of the pocket 190 above the outward radial projection 188 with a portion of the pocket 190 below the outward radial projection 188. In some embodiments, the fluid transfer bore 196 may be sized so as to hinder fluid flow through the fluid transfer bore 196. In some embodiments, the fluid transfer bore 196 may contain a flow limiter 198 that is sized to hinder fluid flow through the fluid transfer bore 196. Examples of flow limiter 198 may include an orifice, venturi, or a device that provides a tortuous fluid path. The outward radial projection 188 may have a pocket seal 200 in contact with a circumferentially surrounding wall 202 of the pocket 190. In some embodiments, the pocket seal 200 may be omitted.

In some embodiments, axial movement of the sleeve 178 from the first position to the second position causes axial movement of the outward radial projection 188. In some embodiments, during axial movement of the outward radial projection 188, the arrangement of the fluid transfer bore 196 and the pocket seal 200 causes at least a portion of the fluid within the pocket 190 to travel through the fluid transfer bore 196 from one side of the outward radial projection 188 to another side of the outward radial projection 188. In this way, the speed of axial movement of the outward radial projection 188, and hence the sleeve 178, may be controlled at least in part by appropriate selection of the number and sizes of the fluid transfer bore(s) 196 and/or the number and sizes of the flow limiter(s) 198 and/or the viscosity of the fluid in the pocket 190.

In some embodiments, the fluid transfer bore 196 and the pocket seal 200 may be omitted. In some embodiments, during axial movement of the outward radial projection 188, at least a portion of the fluid within the pocket 190 moves from one side of the outward radial projection 188 to another side of the outward radial projection 188 via an interface between the outward radial projection 188 and the circumferentially surrounding wall 202 of the pocket 190. In some embodiments, the interface between the outward radial projection 188 and the circumferentially surrounding wall 202 of the pocket 190 is sized to hinder fluid flow through the interface.

In some embodiments, the sleeve 178 may have an upper seal 204 in contact with a circumferentially surrounding wall 206 of the first recess 184 above the pocket 190. In some embodiments, the sleeve 178 may have a lower seal 208 in contact with a circumferentially surrounding wall 210 of the first recess 184 below the pocket 190. In embodiments in which the sleeve 178 has at least one upper seal 204 or least one lower seal 208, the speed of axial movement of the sleeve 178 from the first position to the second position may be controlled at least in part by the rate at which fluid within the pocket 190 moves from one side of the outward radial projection 188 to another side of the outward radial projection 188, as described above. In some embodiments, the upper seal 204 may be omitted. In some embodiments, an upper interface between the sleeve 178 and the circumferentially surrounding wall 206 of the first recess 184 above the pocket 190 may be sized to hinder fluid flow through the upper interface. In some embodiments, the lower seal 208 may be omitted. In some embodiments, a lower interface between the sleeve 178 and the circumferentially surrounding wall 210 of the first recess 184 below the pocket 190 may be sized to hinder fluid flow through the lower interface. In embodiments in which the sleeve 178 has no upper seal 204 and/or no lower seal 208, the speed of axial movement of the sleeve 178 from the first position to the second position may be controlled at least in part by the rate at which fluid moves into the pocket 190 from the central throughbore 106 of the tubular body 104 via the upper interface and/or the rate at which fluid moves into central throughbore 106 of the tubular body 104 from the pocket 190 via the lower interface.

Operation of the time-delay releasable seat assembly 48 may commence with the sleeve 178 in the first position, and may involve landing an actuating object on the seat 172. In some embodiments, the actuating object may be a ball, plug, or dart. In some embodiments, the actuating object may be an item that has been released from an upper part of the inner string assembly 40, such as the first sleeve 142, the first sleeve stop member 152, the second sleeve 158, or the second sleeve stop member 168. In some embodiments, the actuating object may include a combination of any of a ball, a plug, a dart, the first sleeve 142, the first sleeve stop member 152, the second sleeve 158, or the second sleeve stop member 168. The actuating object may impart an axial force on the seat 172. The axial force may be generated at least in part by a hydraulic pressure acting on the actuating object. The seat 172 may transfer at least a portion of the axial force to the collet dogs 174. The collet dogs 174 may transfer at least a portion of the axial force to the sleeve 178 via collet fingers 176. In embodiments in which the sleeve 178 is temporarily retained in the first position by a retaining member 180, the retaining member 180 may be defeated when the axial force acting on the sleeve 178 exceeds a threshold magnitude. When the retaining member 180 is defeated, the sleeve 178 may commence moving axially from the first position to the second position.

The speed of axial movement of the sleeve may be regulated by an interaction between the outward radial projection 188 and the fluid in the pocket 190, as described above. Thus, there may be a time delay between the moment at which the sleeve 178 commences movement away from the first position to the moment at which the sleeve 178 arrives at the second position. If the distance of travel between the first position and the second position is relatively long and/or the speed of axial movement of the sleeve 178 is relatively slow, for example, because of a significant interaction between the outward radial projection 188 and the fluid in the pocket 190, then the time delay may be relatively long. If the distance of travel between the first position and the second position is relatively short and/or the speed of axial movement of the sleeve 178 is relatively fast, for example, because of an insignificant interaction between the outward radial projection 188 and the fluid in the pocket 190, then the time delay may be relatively short. When the sleeve 178 arrives at the second position, the collet dogs 174 may move at least partially into the second recess 186, thereby releasing the seat 172. In some embodiments, the seat 172 may then move axially with respect to the sleeve 178. The seat 172 may move axially away from the sleeve 178. In some embodiments, the actuating object may move axially with the seat 172.

Still referring to FIG. 3B, in some embodiments, the inner string assembly 40 may include a catcher 50. In embodiments in which the inner string assembly 40 includes a time-delay releasable seat assembly 48 as well as a catcher 50, the catcher 50 may be positioned below the time-delay releasable seat assembly 48. The catcher 50 may have a tubular housing 212. The catcher 50 may have a restriction 214 projecting radially inwardly into the central throughbore 106 of the tubular body 104. The restriction 214 may be configured to impede the passage of objects that are sized beyond a selected width or diameter. The catcher 50 may have an upper inner catcher sleeve 216 above the restriction 214. The catcher 50 may have a lower inner catcher sleeve 218 below the restriction 214.

The catcher 50 may have a passage 220 between the upper inner catcher sleeve 216 and the tubular housing 212. The passage 220 may extend between the restriction 214 and the tubular housing 212. The passage 220 may extend between the lower inner catcher sleeve 218 and the tubular housing 212. In some embodiments, the catcher 50 may have a fluid flow path 222 between the central throughbore 106 of the tubular body 104 and the passage 220. In some embodiments, the fluid flow path 222 may be around an end of the upper inner catcher sleeve 216. In some embodiments, the fluid flow path 222 may be through one or more openings in a sidewall of the upper inner catcher sleeve 216. In some embodiments, the fluid flow path 222 may be around an end of the restriction 214. In some embodiments, the fluid flow path 222 may be through a sidewall of the restriction 214. In some embodiments, the fluid flow path 222 may be around an end of the lower inner catcher sleeve 218. In some embodiments, the fluid flow path 222 may be through one or more openings in a sidewall of the lower catcher sleeve 218. In some embodiments, the catcher 50 is configured to facilitate communication of at least some fluid in the central throughbore 106 of the tubular body 104 around an end of, or through a sidewall of, the upper inner catcher sleeve 216, through the passage 220 between the upper inner catcher sleeve 216 and the tubular housing 212, through an extension of the passage 220 between the restriction 214 and the tubular housing 212, and around an end of, or through a sidewall of, the lower inner catcher sleeve 218 back into the central throughbore 106 of the tubular body 104.

In some embodiments, the inner string assembly 40 includes a time-delay releasable seat assembly 48 and a catcher 50. In some embodiments, the inner string assembly 40 includes a time-delay releasable seat assembly 48, but the catcher 50 is omitted. In some embodiments, the inner string assembly 40 includes a catcher 50, but the time-delay releasable seat assembly 48 is omitted. In some embodiments, both the time-delay releasable seat assembly 48 and the catcher 50 are omitted from the inner string assembly 40.

Figure 3C:
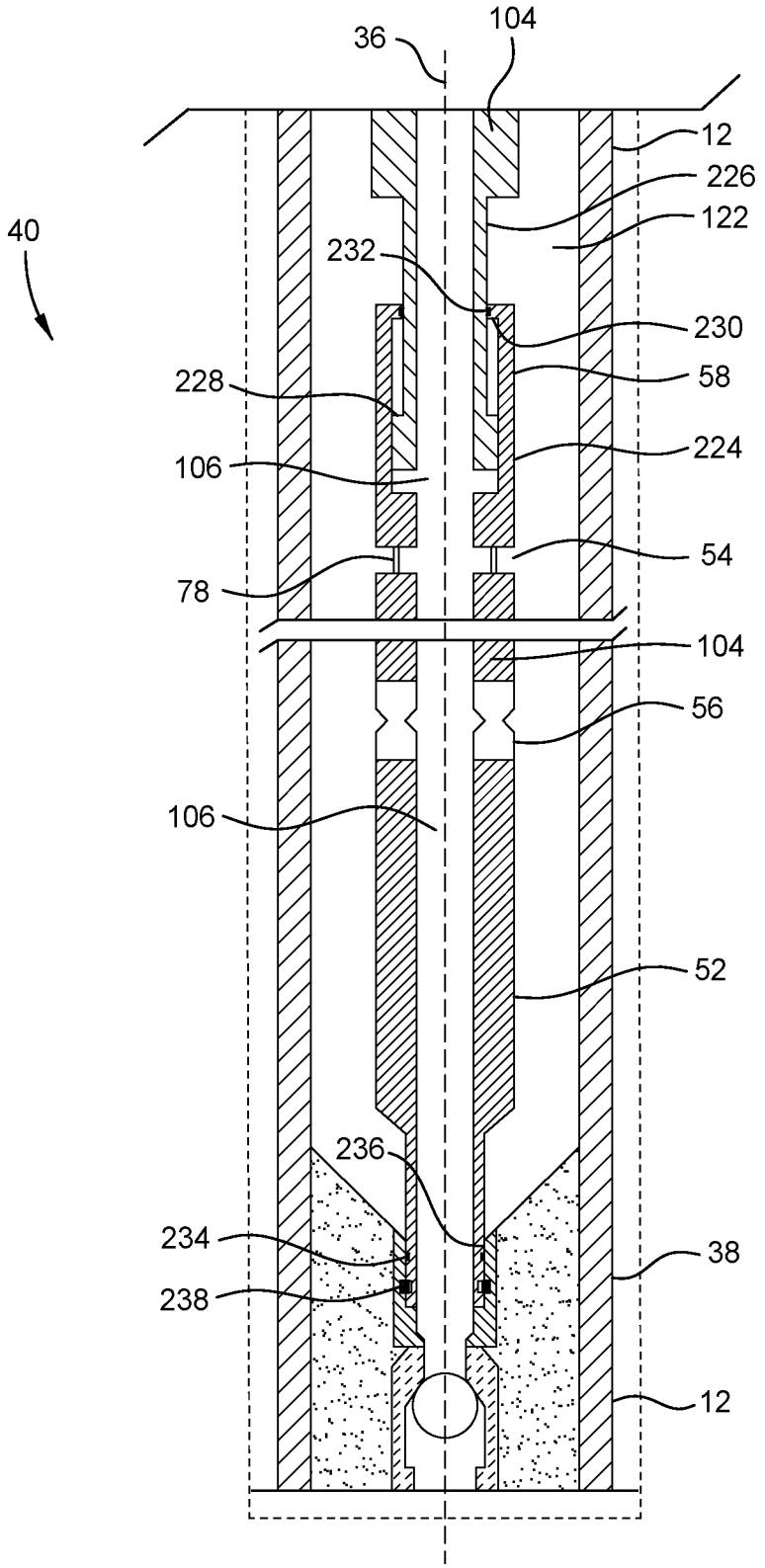
FIG. 3C shows the lower section of the stage cementing system of FIG. 2 in greater detail.

Turning now to FIG. 3C, in some embodiments, the inner string assembly 40 may include an axial slip joint 58. The axial slip joint 58 may have a slip joint inner mandrel 226 telescopically coupled to a slip joint outer mandrel 224. The slip joint inner mandrel 226 may be configured to move axially with respect to the slip joint outer mandrel 224, thereby changing an overall length of the slip joint 58. A shoulder 228 of the slip joint inner mandrel 226 may engage a corresponding shoulder 230 of the slip joint outer mandrel 224 to limit the relative axial movement between the slip joint inner mandrel 226 and the slip joint outer mandrel 224. One of the slip joint inner mandrel 226 and the slip joint outer mandrel 224 may have a seal 232 that contacts the other of the slip joint outer mandrel 224 and the slip joint inner mandrel 226. In some embodiments, the axial slip joint 58 may be omitted from the inner string assembly 40. In some embodiments, the inner string assembly 40 may include a single axial slip joint 58. In some embodiments, the inner string assembly 40 may include a plurality of axial slip joints 58. In some embodiments, the slip joint(s) 58 may be configured such that the application of pressure within the central throughbore 106 of the tubular body 104 does not cause a change in overall length of the slip joint(s) 58.

In some embodiments, the inner string assembly 40 may include a circulation port 54 providing for a fluidic connection between the central throughbore 106 of the tubular body 104 and an exterior of the inner string assembly 40. In some embodiments, during installation of the inner string assembly 40 in the wellbore 10, the circulation port 54 may be open to fluid transfer between the central throughbore 106 of the tubular body 104 and an exterior of the inner string assembly 40. In some embodiments, during installation of the inner string assembly 40 in the wellbore 10, the circulation port 54 may be closed to fluid transfer between the central throughbore 106 of the tubular body 104 and an exterior of the inner string assembly 40 by a barrier member 78. In some embodiments, the barrier member 78 may be a rupture disk that may be defeated by hydraulic pressure in order to open fluid communication through the circulation port 54. In another embodiment, the barrier member 78 may be a sleeve (not shown) external to the inner string assembly 40, the sleeve being movable to open fluid communication through the circulation port 54. In some embodiments, the circulation port 54 may be omitted from the inner string assembly 40. In some embodiments, the circulation port 54 may include a circulation valve. The circulation valve may be configured to selectively open and close a fluid pathway through the circulation port 54. The circulation valve may be configured to permit fluid communication within the central throughbore 106 of the tubular body 104 from above the circulation port 54 to below the circulation port 54 when the circulation port 54 is closed. The circulation valve may be configured to inhibit fluid communication within the central throughbore 106 of the tubular body 104 from above the circulation port 54 to below the circulation port 54 when the circulation port 54 is open.

In some embodiments, the inner string assembly 40 may include a stinger 52 at a lower end thereof. In some embodiments, the stinger 52 may have a seal 234 that is configured to engage a receptacle 236 of a collar 38 installed as part of the casing 12. The collar 38 may be a landing collar. The collar 38 may be a float collar. The collar 38 may be a float shoe. In some embodiments, the stinger 52 may have a latch member 238 configured to engage the collar 38. In some embodiments, the stinger 52 is constructed out of a material that may be easier to disintegrate than regular casing material. In some embodiments, the stinger 52 is constructed out of aluminum. In some embodiments, the stinger 52 is constructed out of plastic. In some embodiments, the stinger 52 is constructed out of a composite material.

In some embodiments, installation of the inner string assembly 40 in the casing 12 includes latching the stinger 52 into the collar 38. The inner string assembly 40 above the axial slip joint 58 may then be moved axially in order to mate the locator dog members 110 with the internal location profile 60. Such axial movement of the inner string assembly 40 may be accommodated by the telescopic relative axial movement between the slip joint inner mandrel 226 and the slip joint outer mandrel 224. In other embodiments, the stinger 52 may be omitted from the inner string assembly 40.

In some embodiments, the inner string assembly 40 may include a separable member 56. In some embodiments, the separable member 56 may be installed in the inner string assembly 40 above the stinger 52. The separable member 56 may include a connection that is configured to separate upon experiencing a tensile load that exceeds a threshold. In some embodiments, the separable member 56 may be omitted from the inner string assembly 40.

Methods of operation of the stage cementing system 20 will now be described. In some embodiments, the methods of operation include the step of installing the stage cementing system 20 into the wellbore 10. During installation, fluids in the wellbore 10, and any fluids introduced into the stage cementing system 20 and/or into the wellbore 10 exert pressures on the internal and external portions of the casing 12 and the components of the stage cementing system 20. Referring back to FIG. 3A, a regulation of such pressures may be accomplished as follows. If the pressure external to the casing 12 and/or stage tool 24 exceeds the pressure within the casing 12 and/or stage tool 24, the casing 12 and/or stage tool 24 will experience a net collapse force. The net collapse force may be mitigated by introducing fluid into the annular volume between the inner string assembly 40 and the casing 12. The fluid may be introduced into an upper end of the casing 12, and may enter the fourth annular compartment 128. The fluid may enter the bypass 130. The fluid may enter the first annular compartment 122. The fluid may fill the first annular compartment 122 from the collar 38 to the lower seal element 120. If the pressure external to the stage tool 24 exceeds the pressure within the second annular compartment 124, the stage tool 24 will experience a net collapse force at the vicinity of the second annular compartment 124. If the pressure external to the stage tool 24 exceeds the pressure within the second annular compartment 124 by a threshold magnitude, the net collapse force may be mitigated by the relief valve 80 opening to allow fluid external to the stage tool 24 to enter the stage tool 24 and move through the first inner port 68 of the stage tool 24 into the second annular compartment 124. If the pressure external to the stage tool 24 exceeds the pressure within the third annular compartment 126, the stage tool 24 will experience a net collapse force at the vicinity of the third annular compartment 126. To mitigate the net collapse force at the vicinity of the third annular compartment 126, fluid in the bypass 130 may enter the third annular compartment 126 through the relief valve 138 when a pressure of the fluid in the bypass 130 exceeds the pressure within the third annular compartment 126 by a threshold magnitude. Pressure differentials leading to net burst and/or collapse forces that are experienced by components of the inner string assembly 40 may be mitigated by any of the above measures. Pressure differentials leading to net burst and/or collapse forces that are experienced by components of the inner string assembly 40 may be mitigated by introducing fluid into the central throughbore 106 of the tubular body 104 of the inner string assembly 40. Pressure differentials leading to net burst and/or collapse forces that are experienced by components of the inner string assembly 40 may be mitigated by introducing fluid into the fourth annular compartment 128, for example at the top of the casing 12. Additionally, or alternatively, if the circulation port 54 includes a circulation valve, as described above, fluid may be circulated down the central throughbore 106 of the tubular body 104, through the circulation port 54 into the first annular compartment 122, through the bypass 130, and into the fourth annular compartment 128.

FIGS. 5 to 14 illustrate an example method of operation of the stage cementing system 20. In some embodiments, the stage cementing system 20 may not include all the components described above. In some embodiments, the method of operation may not include all the steps described below. The figures illustrate the stage cementing system 20 installed in a wellbore 10.

Figure 5:
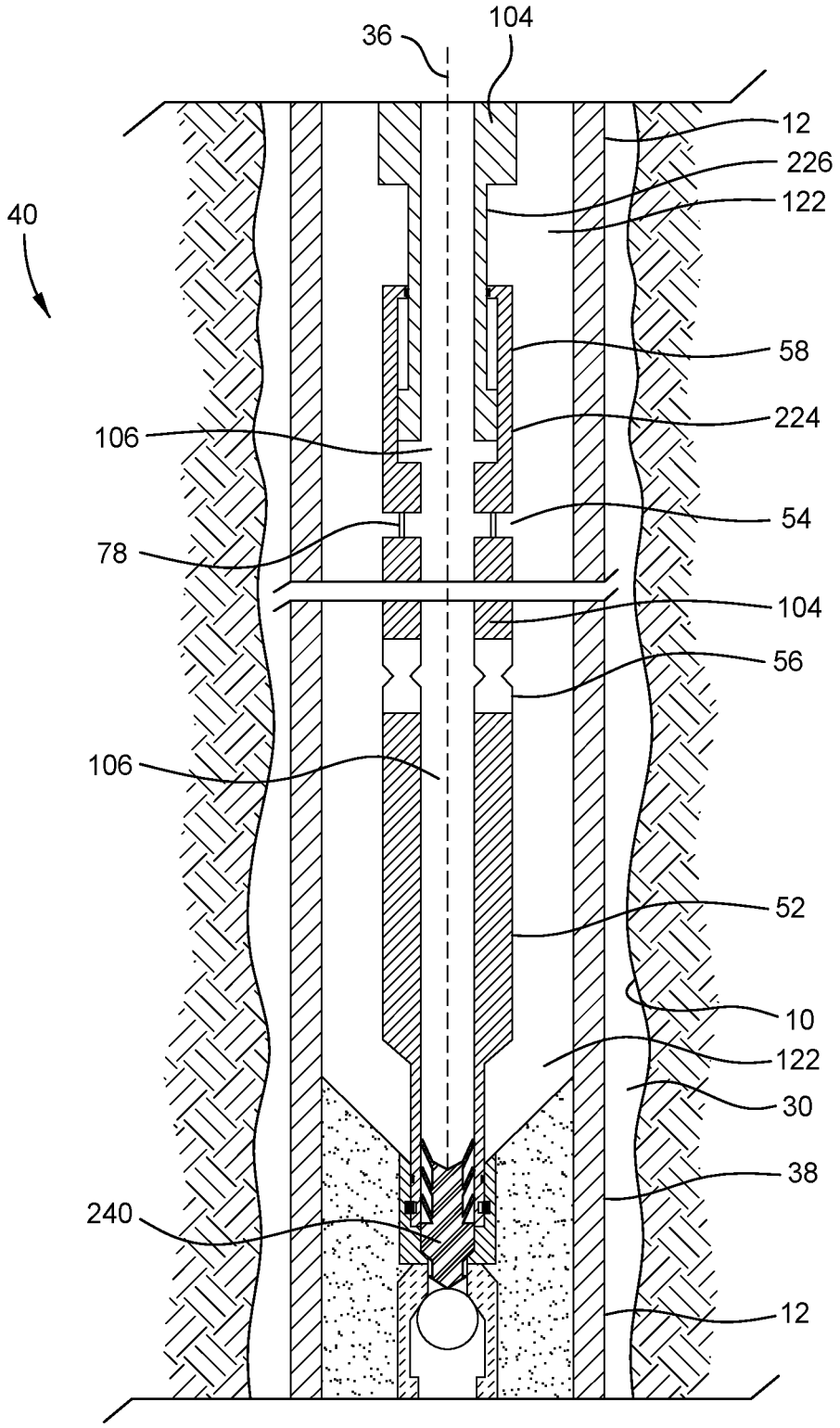
FIGS. 5 to 14 show steps of methods of cementing a wellbore tubular using the stage cementing system of FIG. 2.

FIG. 5 shows a casing 12 in a wellbore 10. The casing 12 includes a collar 38. The collar 38 may be a landing collar. The collar 38 may be a float collar. The collar 38 may be a float shoe. As illustrated, the collar 38 has a float valve. A stinger 52 of the inner string of the stage cementing system 20 is shown engaged with a receptacle 236 of the collar 38. A first actuating object 240 is shown engaged with the collar 38. In some embodiments, the first actuating object 240 is brought into engagement with the collar 38 by conveying the first actuating object 240 through the inner string assembly 40 by pumping a fluid behind the first actuating object 240 as the first actuating object 240 travels through the inner string assembly 40. The first actuating object 240 may be sized so as to pass through any sleeves, stop members, restrictions, and other obstacles in the central throughbore 106 of the tubular body 104 of the inner string assembly 40. The first actuating object 240 may be a ball, plug, or dart. In some embodiments, the first actuating object 240 may be a dart that is used to displace a fluid, such as cement, through the collar 38 and into annulus 30 between the casing 12 and the wellbore 10. In some embodiments, the first actuating object 240 may be a dart that is used to displace a fluid other than cement through the collar 38 and into annulus 30 between the casing 12 and the wellbore 10. In some embodiments, the first actuating object 240 seals against the stinger 52 and/or the collar 38, thereby preventing any further passage of fluid from the inner string assembly 40 through the collar 38.

Figure 6:
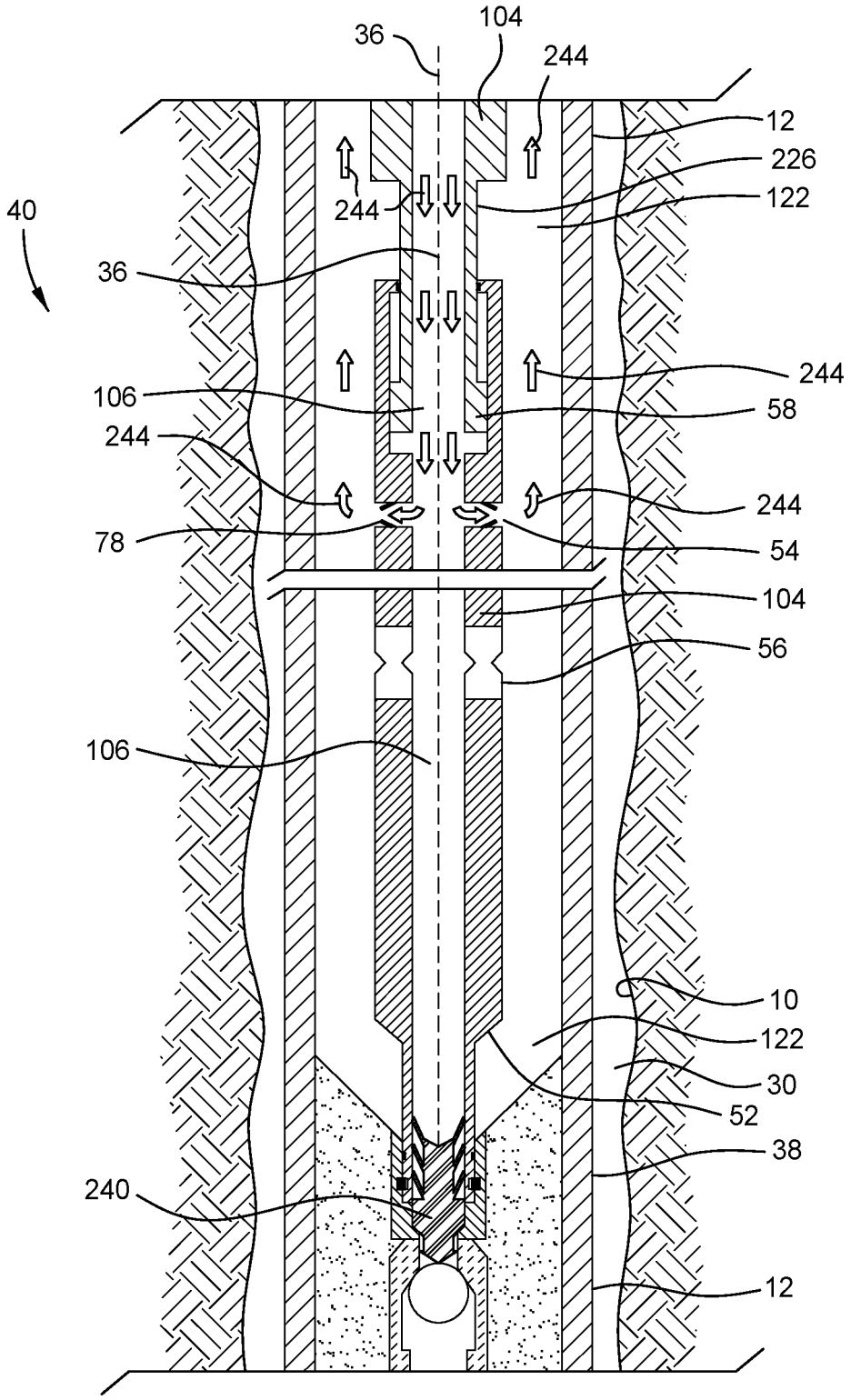

As shown in FIG. 6, applying hydraulic pressure through the inner string assembly 40 against the landed first actuating object 240 causes the circulation port 54 to open. As shown, the barrier member 78 of the circulation port 54 is defeated when the pressure inside the inner string assembly 40 at the barrier member 78 exceeds a pressure in the first annular compartment 122 at the barrier member 78 by a threshold magnitude. In some embodiments, the pressure at which the circulation port 54 opens may be selected to be lower than the pressure at which other tools of the stage cementing system 20 are configured to be actuated. With the circulation port 54 opened to fluid flow, in some embodiments, the method may include circulating a fluid (shown by arrows 244) down through the inner string assembly 40, through the circulation port 54 into the first annular compartment 122, then through the bypass 130 (not shown in FIG. 6) into the fourth annular compartment 128, and then out of the wellbore 10. Such circulating may assist the removal of unwanted material, such as previously-pumped cement, from the inner string assembly 40. Such circulating may provide assurance that a second actuating object may be pumped into place as part of a following step of the method of operation.

Figure 7:
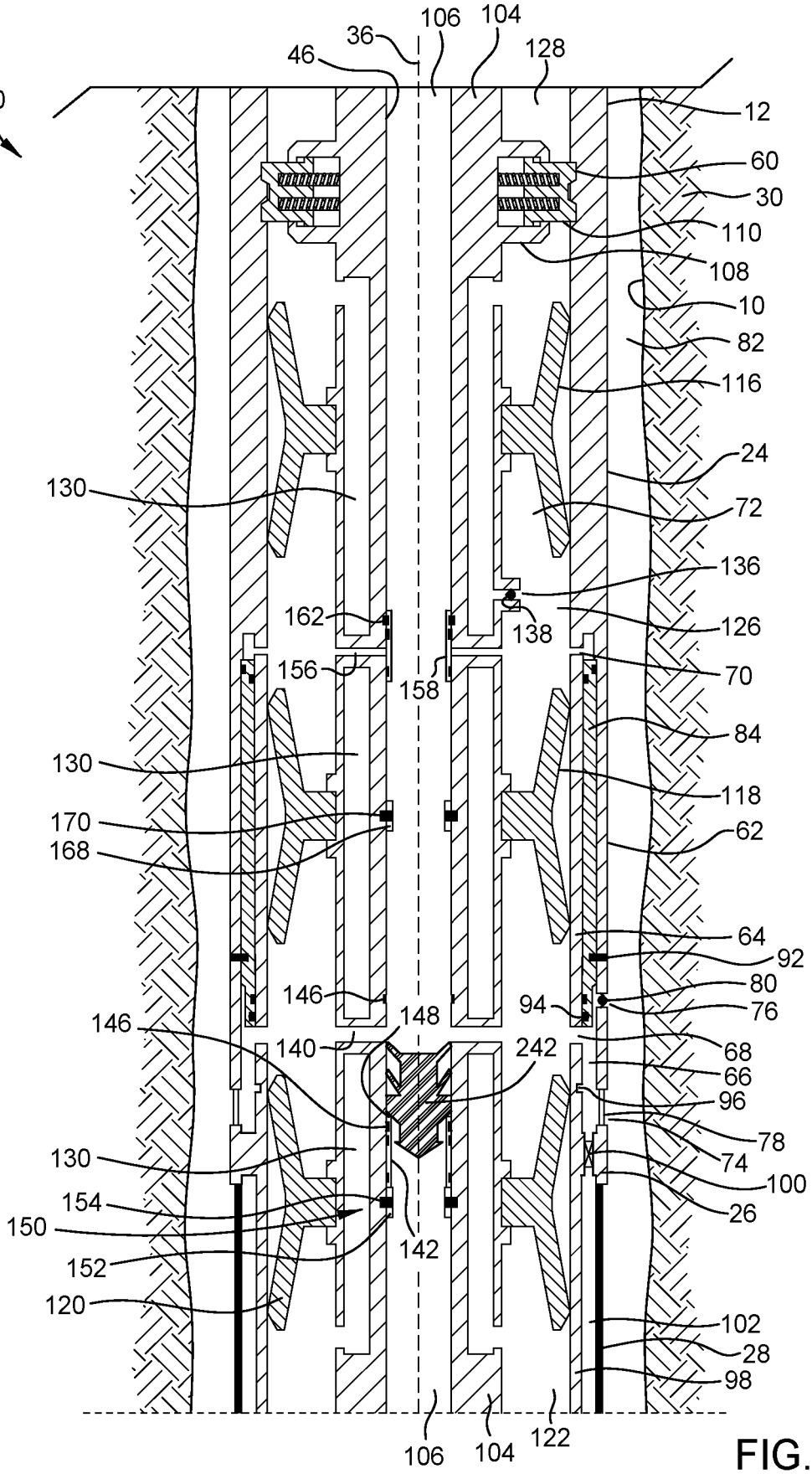

FIG. 7 shows an upper portion of the stage cementing system 20 at a further step of the method of operation. A second actuating object 242 is pumped through the inner string assembly 40 and lands on the first sleeve 142. The second actuating object 242 may land on the seat 148 of the first sleeve 142. The second actuating object 242 may be sized so as to pass through any sleeves, stop members, restrictions, and other obstacles in the central throughbore 106 of the tubular body 104 of the inner string assembly 40 that are located above the first sleeve 142. The second actuating object 242 may be a ball, plug, or dart. The second actuating object 242 may substantially seal against the seat 148 and/or the first sleeve 142. The method may involve applying hydraulic pressure to the second actuating object 242 sufficient to provide a force on the first sleeve 142 that defeats the retaining member 146 of the first sleeve 142. With the retaining member 146 defeated, the first sleeve 142 and the second actuating object 242 moves down to the first sleeve stop assembly 150, and opens the first side port 140 of the inner string assembly 40. Fluid may now be communicated from the central throughbore 106 of the tubular body 104 of the inner string assembly 40, through the first side port 140 into the second annular compartment 124, and into the annular chamber 66 between the stage tool outer mandrel 62 and the stage tool inner mandrel 64 through the first inner port 68 of the stage tool inner mandrel 64. In embodiments in which the stage tool assembly 22 includes a packer 26, fluid may now be communicated in this route from the central throughbore 106 of the tubular body 104 of the inner string assembly 40 through the packer 26 valve assembly 100 and into the internal chamber 102 of the packer 26. In the embodiment shown in the figures, the packer 26 is an inflatable packer, and thus in this embodiment, the fluid introduced into the internal chamber 102 of the packer 26 will inflate the packer 26.

Figure 8:
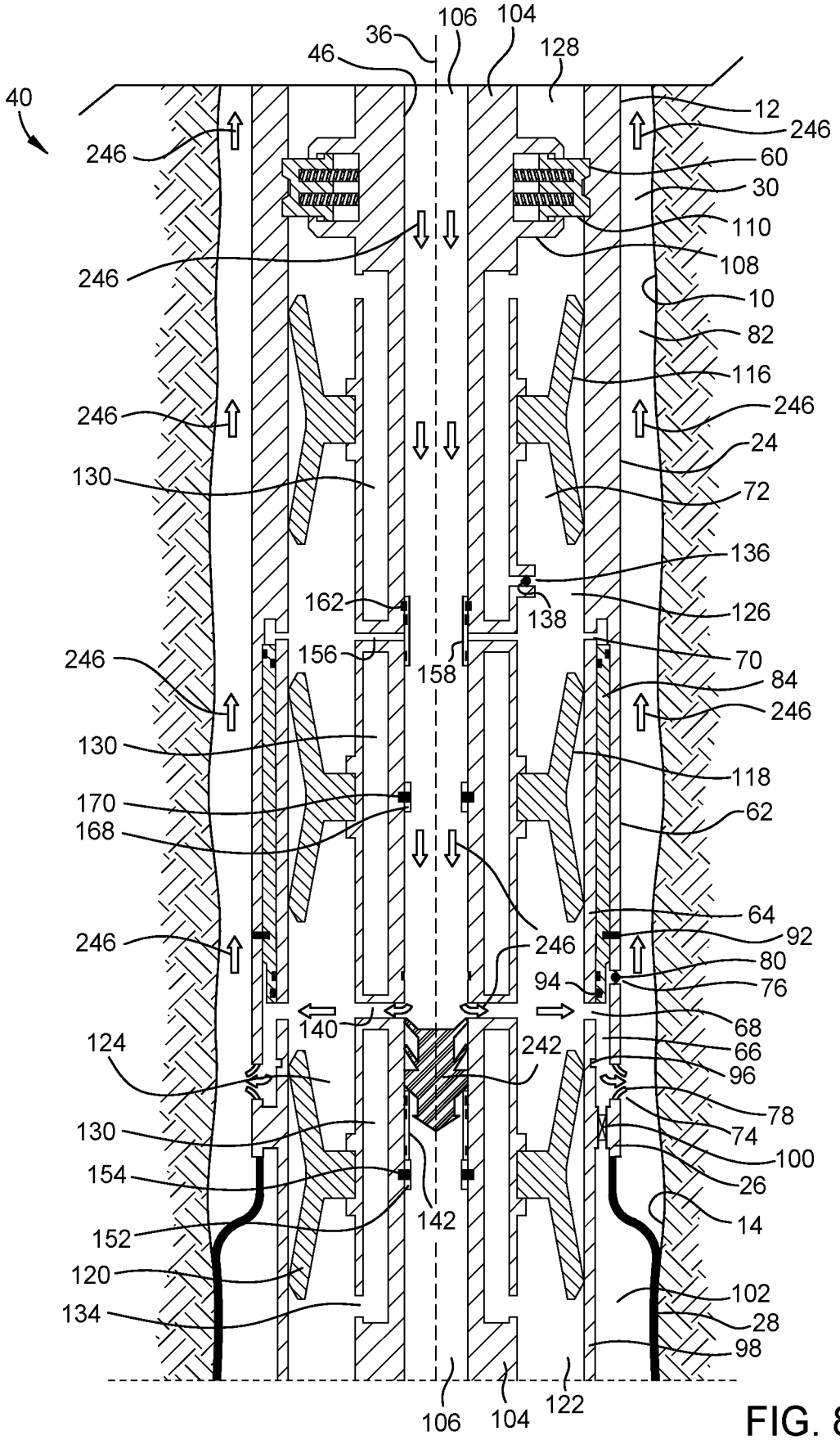

FIG. 8 shows the packer 26 in an inflated condition with packer seal 28 in contact with the wall 14 of the wellbore 10, and the packer valve assembly 100 has closed. FIG. 8 also shows a next step of the method, namely the application of a hydraulic pressure from the central throughbore 106 of the tubular body 104 of the inner string assembly 40, through the first side port 140 into the second annular compartment 124, and into the annular chamber 66 between the stage tool outer mandrel 62 and the stage tool inner mandrel 64 through the first inner port 68 of the stage tool inner mandrel 64. When the applied hydraulic pressure exceeds a threshold magnitude, the barrier member 78 associated with the first outer port 74 of the stage tool outer mandrel 62 is defeated, thereby allowing fluid to flow from inside the stage tool 24 into the annulus 30 between the stage tool 24 and the wellbore 10. As shown in FIG. 8, the method may involve the pumping of cement, and/or another fluid (shown by arrows 246), into the central throughbore 106 of the tubular body 104 of the inner string assembly 40, through the first side port 140 into the second annular compartment 124, through the first inner port 68 of the stage tool inner mandrel 64 into the annular chamber 66 between the stage tool outer mandrel 62 and the stage tool inner mandrel 64, and through the first outer port 74 of the stage tool outer mandrel 62 into the annulus 30 between the stage tool 24 and the wellbore 10.

Figure 9:
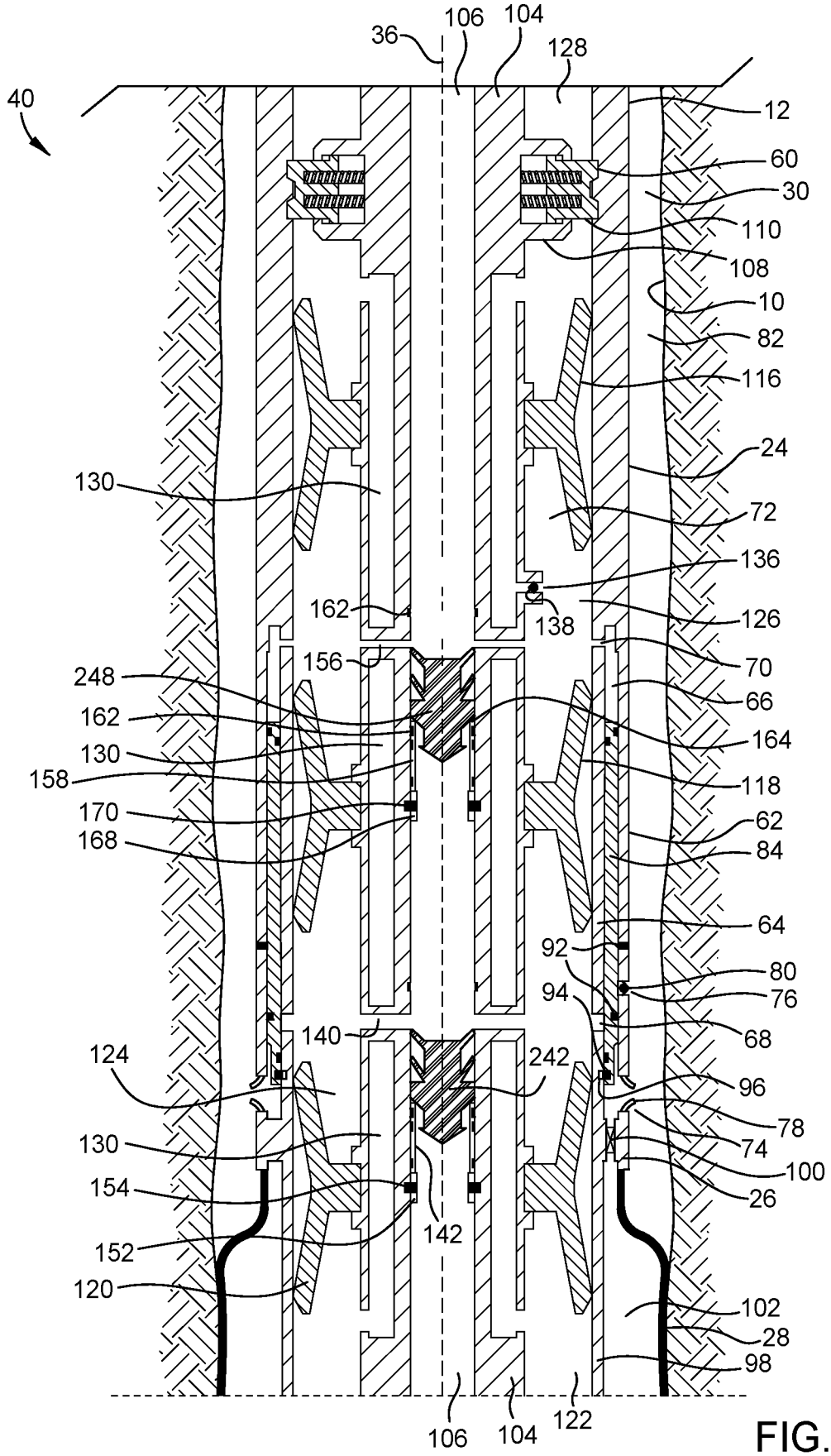

FIG. 9 illustrates the aftermath of additional steps in the method. The pumping of cement, and/or another fluid, as described above, may include the conveyance of a third actuating object 248 into the central throughbore 106 of the tubular body 104 of the inner string assembly 40. The third actuating object 248 is pumped through the inner string assembly 40 and lands on the second sleeve 158. The third actuating object 248 may land on the seat 164 of the second sleeve 158. The third actuating object 248 may be sized so as to pass through any sleeves, stop members, restrictions, and other obstacles in the central throughbore 106 of the tubular body 104 of the inner string assembly 40 that are located above the second sleeve 158. The third actuating object 248 may be a ball, plug, or dart. The third actuating object 248 may substantially seal against the seat 164 and/or the second sleeve 158. The method may involve applying hydraulic pressure to the third actuating object 248 sufficient to provide a force on the second sleeve 158 that defeats the retaining member 162 of the second sleeve 158. With the retaining member 162 defeated, the second sleeve 158 and the third actuating object 248 moves down to the second sleeve stop assembly 166, and opens the second side port 156 of the inner string assembly 40.

Fluid may now be communicated from the central throughbore 106 of the tubular body 104 of the inner string assembly 40, through the second side port 156 into the third annular compartment 126, and into the annular chamber 66 between the stage tool outer mandrel 62 and the stage tool inner mandrel 64 through the second inner port 70 of the stage tool inner mandrel 64. In some embodiments, a hydraulic pressure applied through this communication route may not also be applied into the second annular compartment 124 and then through the first inner port 68 of the stage tool inner mandrel 64. The sealing provided by the third actuating object 248 within the central throughbore 106 of the tubular body 104 of the inner string assembly 40 blocks fluid access to the first side port 140. Additionally, the middle seal element 118 inhibits fluid communication between the third annular compartment 126 and the second annular compartment 124. Hence, a hydraulic pressure applied via the interior 72 of the stage cementing assembly 22 through the second inner port 70 of the stage tool inner mandrel 64 may not also be experienced through the first inner port 68 of the stage tool inner mandrel 64.

Thus, when the method entails the applying of a hydraulic pressure via the central throughbore 106 of the tubular body 104 of the inner string assembly 40, through the second side port 156 into the third annular compartment 126, and into the annular chamber 66 between the stage tool outer mandrel 62 and the stage tool inner mandrel 64 through the second inner port 70 of the stage tool inner mandrel 64, the closing sleeve 84 experiences a net downward force. When the applied pressure exceeds a threshold, the net downward force on the closing sleeve 84 is sufficient to defeat the retaining member 92 and/or the biasing member that heretofore had been holding the closing sleeve 84 in place, and the closing sleeve 84 may now be moved. The method may further include applying such pressure via the central throughbore 106 of the tubular body 104 of the inner string assembly 40, through the second side port 156 into the third annular compartment 126, and into the annular chamber 66 between the stage tool outer mandrel 62 and the stage tool inner mandrel 64 through the second inner port 70 of the stage tool inner mandrel 64 to defeat the retaining member 92 and/or (if present) the biasing member (not shown) and move the closing sleeve 84 to the position illustrated in FIG. 9. In this position, the closing sleeve 84 prevents fluid communication between the second annular compartment 124 or third annular compartment 126 and the annulus 30 between the wellbore 10 and the casing 12 due to the first, second, and third seals 86, 88, 90 of the closing sleeve 84. In some embodiments, upon moving the closing sleeve 84 to the position illustrated in FIG. 9, the snap ring 94 may engage the detent 96. Hence, the closing sleeve 84 may be retained in position.

Figure 10:
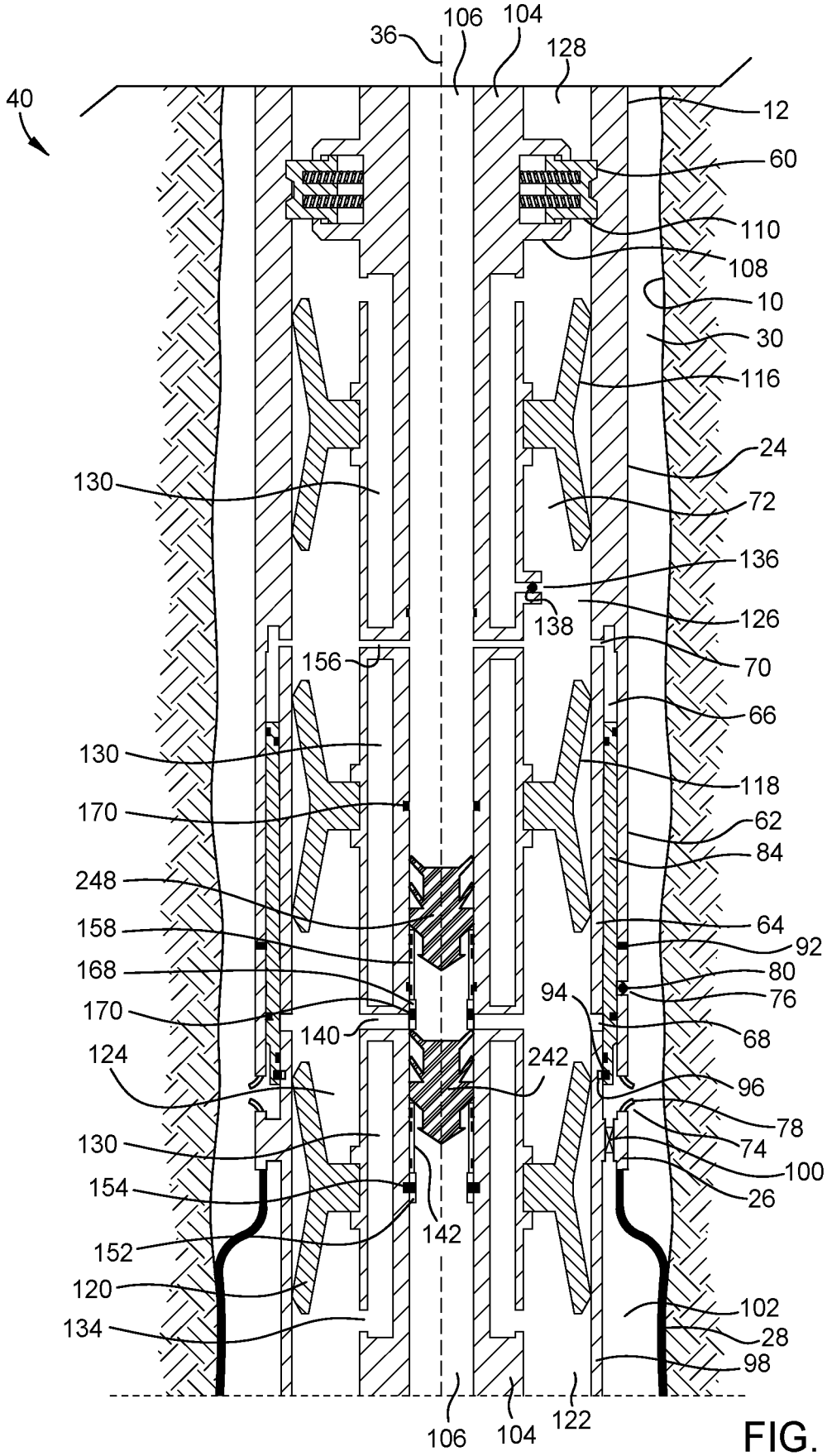

In some embodiments, the method may involve additional subsequent steps. For example, if it is desired to reestablish a circulation path through the circulation port 54 of the inner string assembly 40, and/or to pressure test the stage tool 24 while the inner string assembly 40 remains in place, the method may involve the moving of the second actuating object 242 and the third actuating object 248 to locations in which they do not interfere with such operations. The method may involve applying hydraulic pressure to the third actuating object 248 via the central throughbore 106 of the tubular body 104 of the inner string assembly 40 so as to impart a force onto the second sleeve 158 and onto the second sleeve stop member 168. When the pressure exceeds a threshold magnitude, the force may be sufficient to defeat the retaining member 170 that holds the second sleeve stop member 168 in position. Thus, the second sleeve stop member 168, the second sleeve 158, and the third actuating object 248 may travel down the central throughbore 106 of the tubular body 104 of the inner string assembly 40 until encountering the second actuating object 242, the first sleeve 142, and the first sleeve stop member 152. This situation is illustrated in FIG. 10.

Figure 11A:
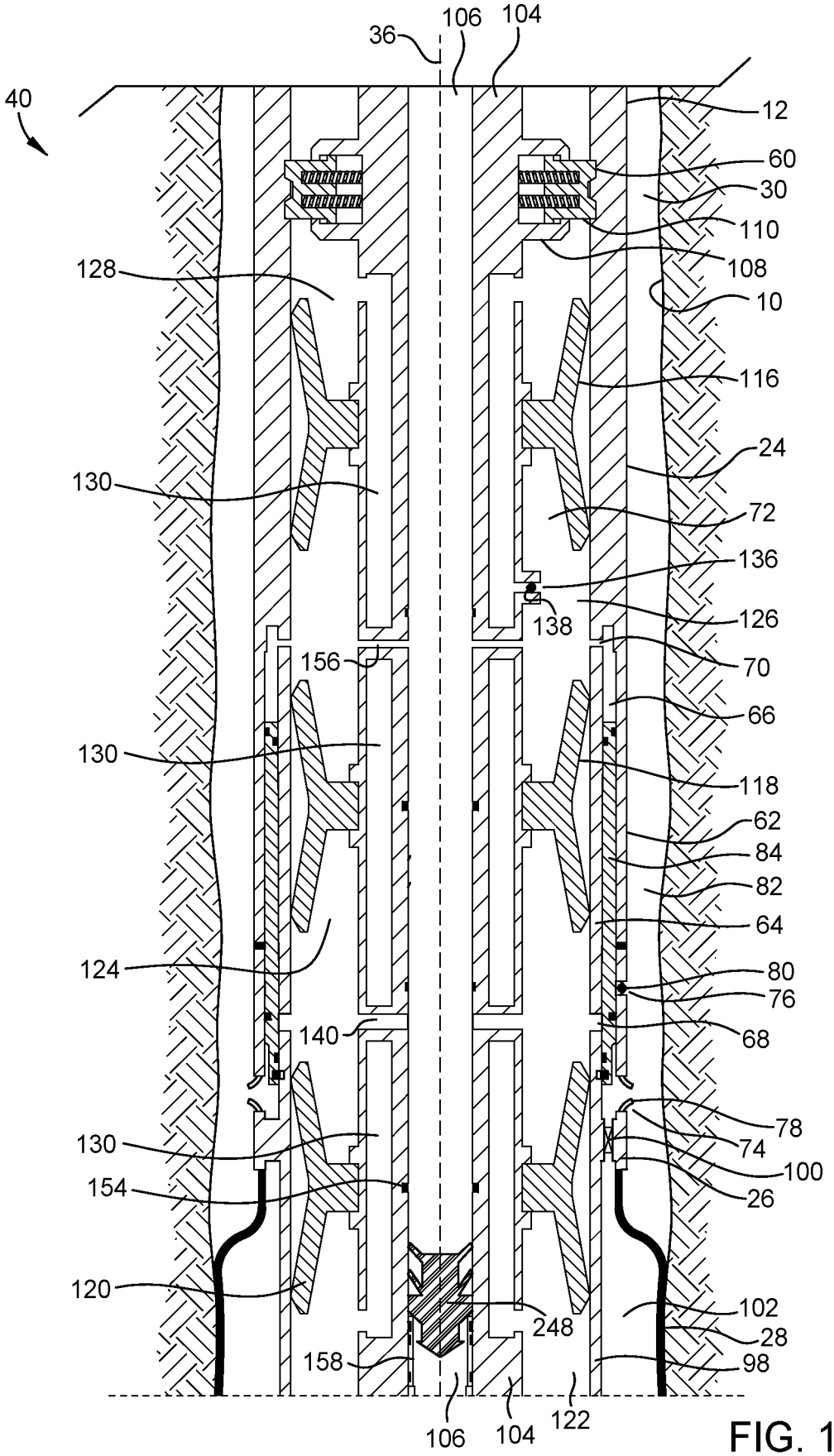
Figure 11B:
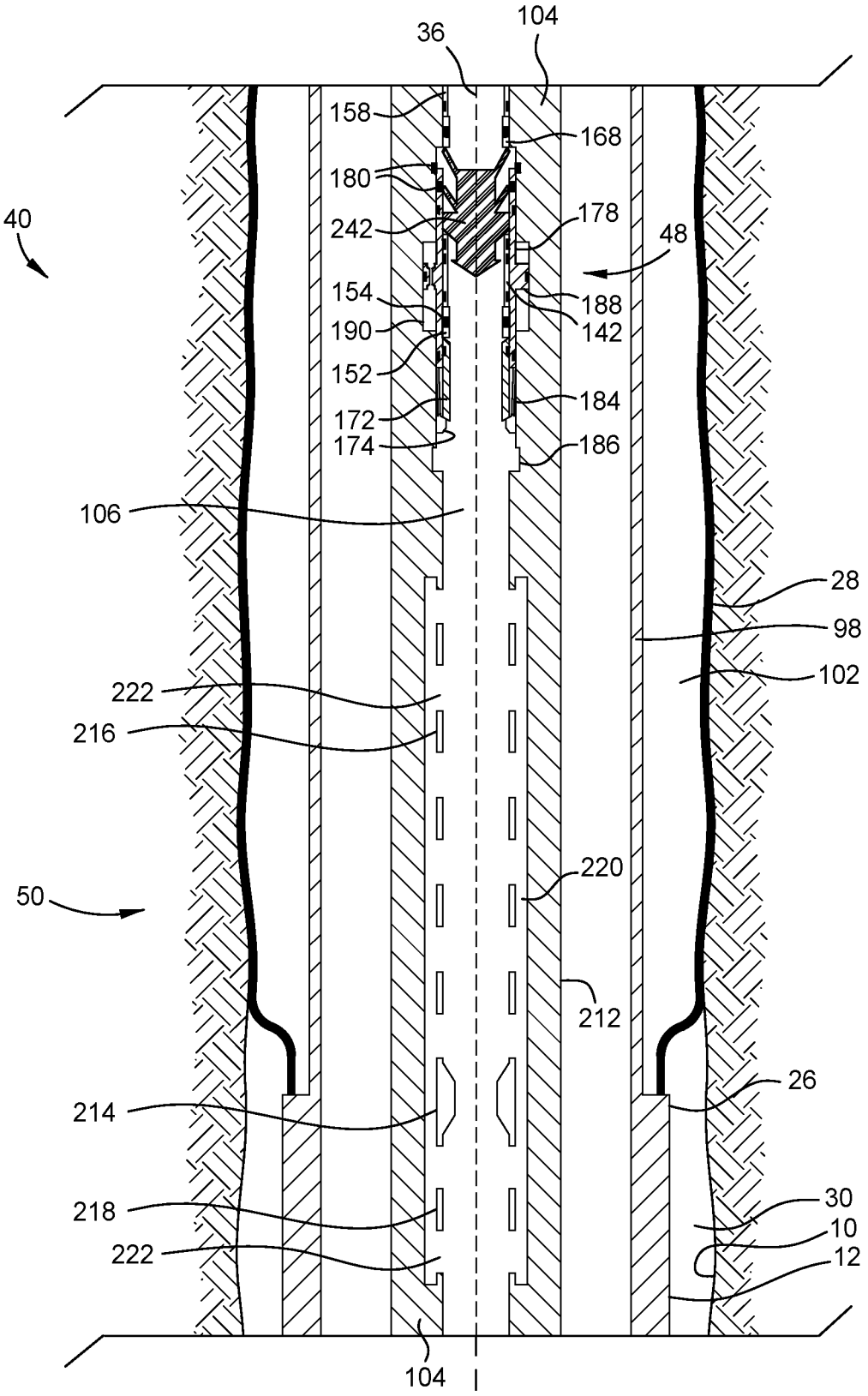

FIGS. 11A and 11B illustrate further steps of the method in some embodiments. The method may involve applying hydraulic pressure to the third actuating object 248 via the central throughbore 106 of the tubular body 104 of the inner string assembly 40 so as to impart a force onto the second sleeve 158, the second sleeve stop member 168, the second actuating object 242, the first sleeve 142, and the first sleeve stop member 152. When the pressure exceeds a threshold magnitude, the force may be sufficient to defeat the retaining member 154 that holds the first sleeve stop member 152 in position. Thus, the first sleeve stop member 152, the first sleeve 142, the second actuating object 242, the second sleeve stop member 168, the second sleeve 158, and the third actuating object 248 may travel down the central throughbore 106 of the tubular body 104 of the inner string assembly 40 until encountering the seat 172 of the time-delay releasable seat assembly 48.

The method may involve applying hydraulic pressure to the third actuating object 248 via the central throughbore 106 of the tubular body 104 of the inner string assembly 40 so as to impart a force onto the second sleeve 158, the second sleeve stop member 168, the second actuating object 242, the first sleeve 142, the first sleeve stop member 152, and the seat 172 of the time-delay releasable seat assembly 48. The force is also applied from the seat 172 of the time-delay releasable seat assembly 48 to the sleeve 178 of the time-delay releasable seat assembly 48 via the collet dogs 174 and collet fingers 176. When the pressure exceeds a threshold magnitude, the force may be sufficient to defeat the retaining member 180 that holds the sleeve 178 of the time-delay releasable seat assembly 48 in position. Thus, the sleeve 178, collet fingers 176, collet dogs 174, and seat 172 of the time-delay releasable seat assembly 48, plus the first sleeve stop member 152, the first sleeve 142, the second actuating object 242, the second sleeve stop member 168, the second sleeve 158, and the third actuating object 248 may travel down the central throughbore 106 of the tubular body 104 of the inner string assembly 40.

FIG. 11B illustrates the sleeve 178 of the time-delay releasable seat assembly 48 part-way through its travel. Travel of the sleeve 178 of the time-delay releasable seat assembly 48 (and hence also the other items listed above) may be hindered by the resistance imparted by fluid in the pocket 190 of the time-delay releasable seat assembly 48 moving through the fluid transfer bore 196 of the outward radial projection 188 of the sleeve 178 of the time-delay releasable seat assembly 48. The continued application of pressure on the third actuating object 248 may (eventually) move the sleeve 178 of the time-delay releasable seat assembly 48 to the end of its travel. While the sleeve 178 of the time-delay releasable seat assembly 48 is in transit, the seat 172 of the time-delay releasable seat assembly 48 remains engaged with the collet dogs 174.

Referring back to FIG. 11A, it will be noted that the first side port 140 and second side port 156 of the inner string assembly 40 are no longer obscured. Thus the method may further include the continued application of pressure through the central throughbore 106 of the tubular body 104 of the inner string assembly 40 in order to perform a pressure test of the stage tool 24. The test pressure may be applied through the first side port 140 in to the second annular compartment 124, and through the second side port 156 into the third annular compartment 126. The magnitude of the test pressure may be selected to be at least equal to the maximum pressure applied to the interior 72 of the stage tool 24 during operation of the stage cementing system 20. The test pressure may be applied for so long as the sleeve 178 of the time-delay releasable seat assembly 48 remains in transit.

Figure 12:
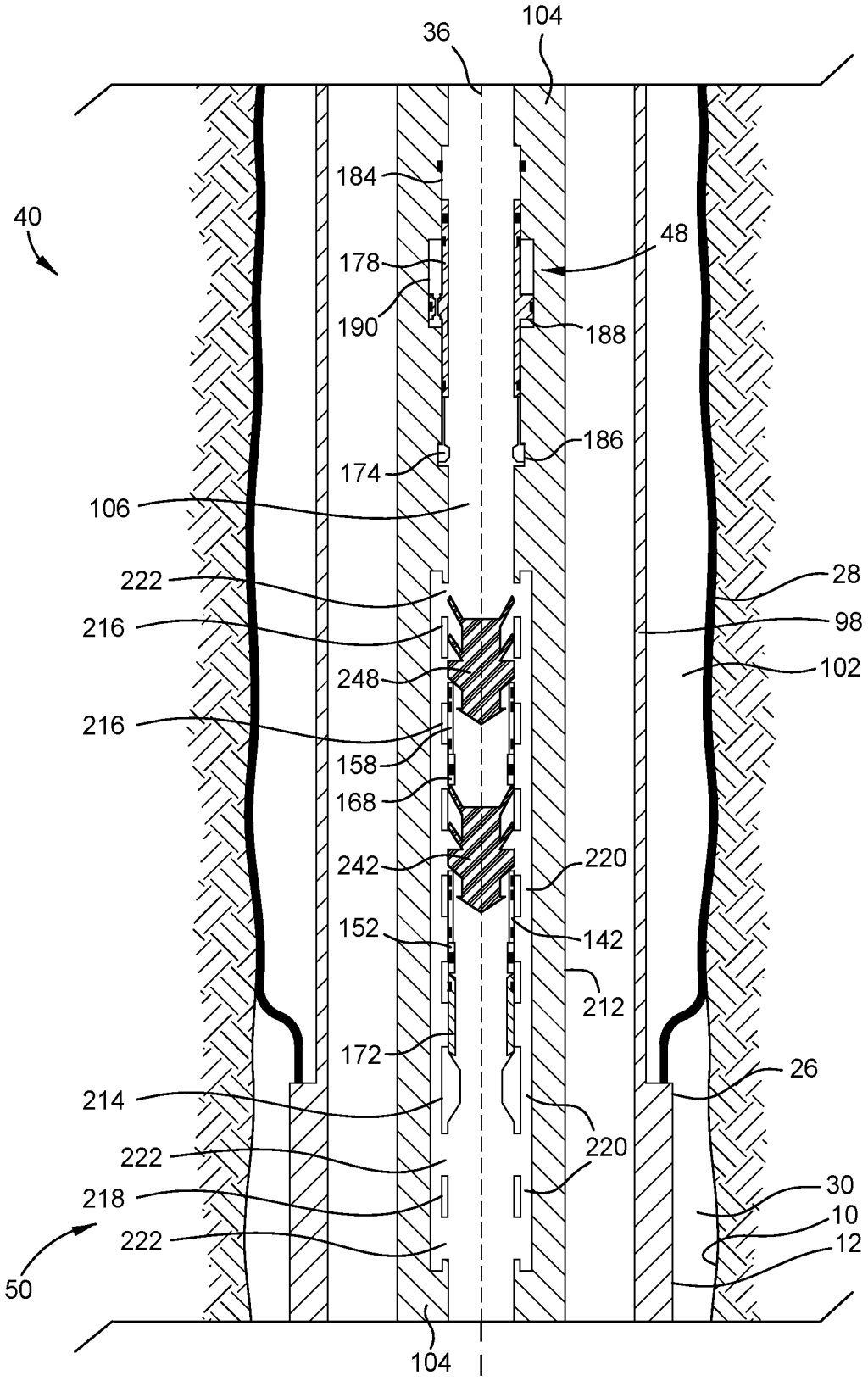

In some embodiments, there are further steps of the method, as illustrated in FIG. 12. The continued application of pressure on the third actuating object 248 moves the sleeve 178 of the time-delay releasable seat assembly 48 to the end of its travel. At this point, the collet dogs 174 may move at least partially into the second recess 186 of the time-delay releasable seat assembly 48. The collet dogs 174 may then release the seat 172 of the time-delay releasable seat assembly 48. The continued application of pressure on the third actuating object 248 may move the seat 172 of the time-delay releasable seat assembly 48, the first sleeve stop member 152, the first sleeve 142, the second actuating object 242, the second sleeve stop member 168, the second sleeve 158, and the third actuating object 248 down the central throughbore 106 of the tubular body 104 of the inner string assembly 40 and into the catcher 50 until the seat 172 of the time-delay releasable seat assembly 48 encounters the restriction 214 of the catcher 50.

At this point, the seat 172 of the time-delay releasable seat assembly 48 and the items that had been traveling along with it become contained within the catcher 50. Fluid circulation may now be established via the central throughbore 106 of the tubular body 104 of the inner string assembly 40 above the catcher 50, the fluid flow path 222 through or around the upper inner catcher sleeve 216 of the catcher 50, the passage 220 of the catcher 50, the fluid flow path 222 through or around the lower inner catcher sleeve 218 of the catcher 50, back into the central throughbore 106 of the tubular body 104 of the inner string assembly 40 below the catcher 50. Fluid circulation may continue out through the circulation port 54 of the inner string assembly 40, through the first annular compartment 122, and through the bypass 130 into the fourth annular compartment 128, as before.

Figure 13:
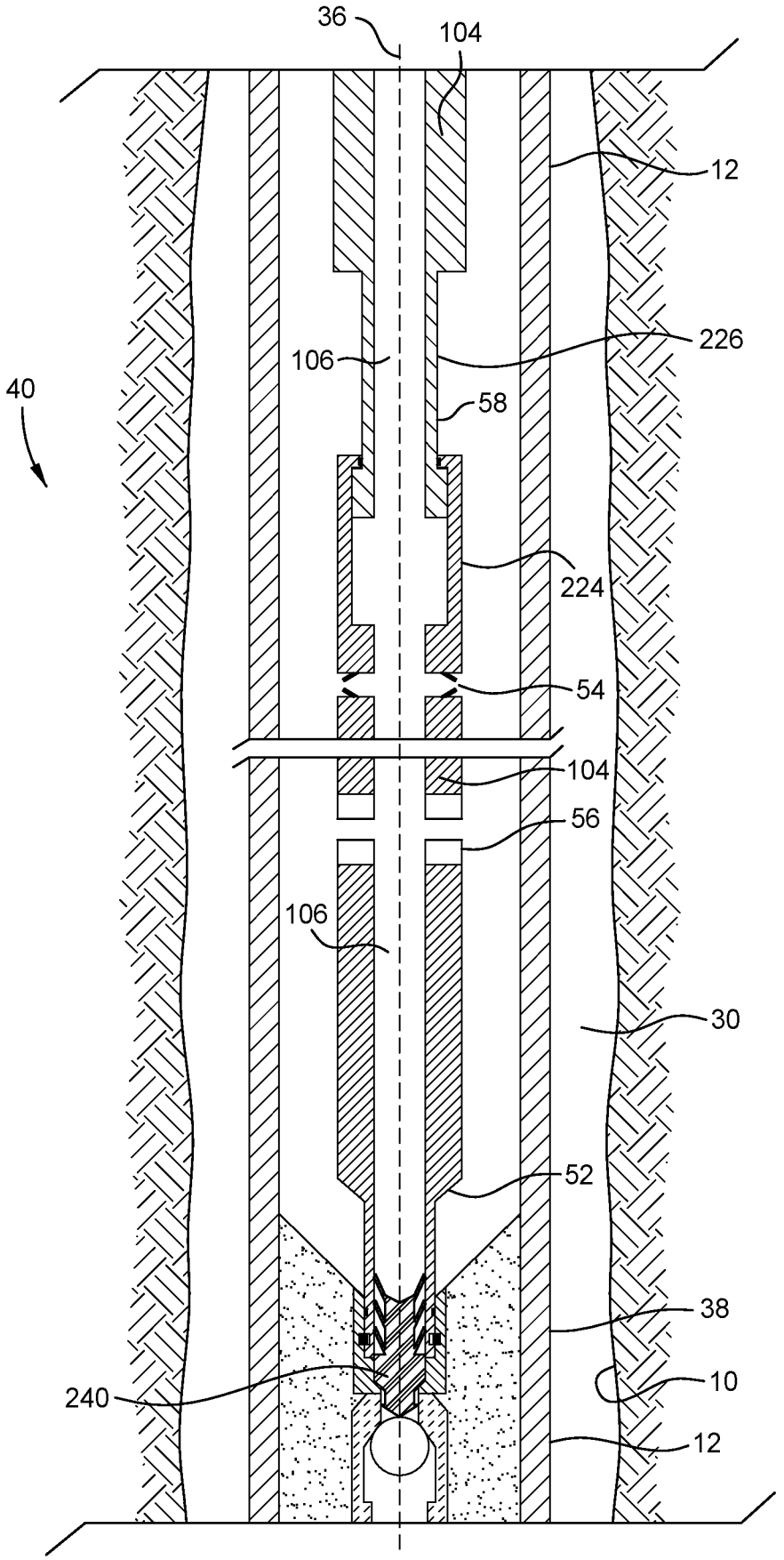
Figure 14:
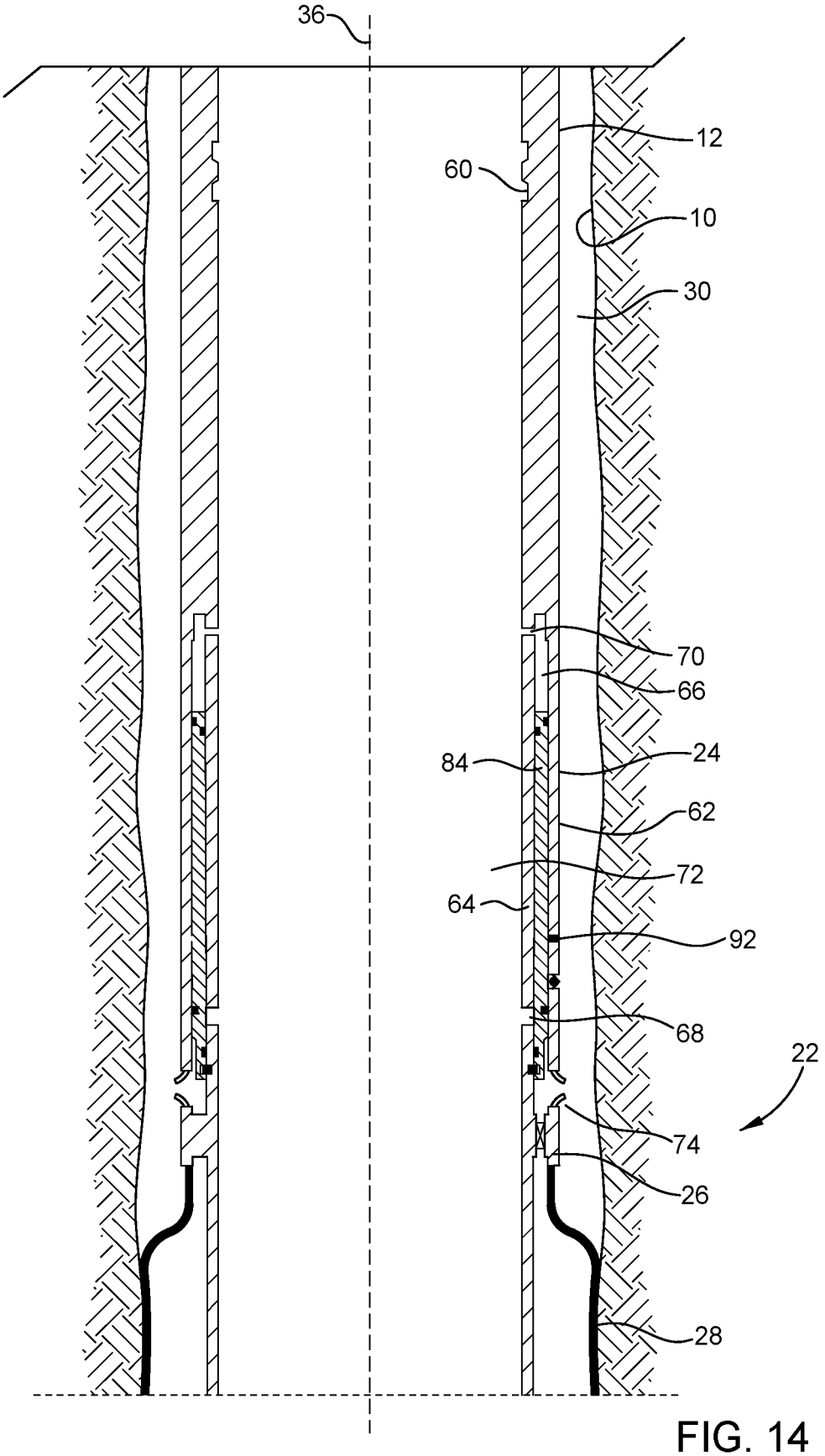

In some embodiments, there are still further steps of the method, as illustrated in FIG. 13. In some embodiments, the inner string assembly 40 may be retrieved from the casing 12 by applying an axial pull force on the inner string assembly 40 via the workstring to which the inner string assembly 40 is coupled. In some embodiments, the step of applying the axial pull force will cause the dog members of the locator 46 to disengage from the internal location profile 60 of the casing 12 and/or of the stage cementing assembly 22. The method may include the further application of an axial pull force on the inner string assembly 40, thereby raising the inner string assembly 40 located above the axial slip joint 58, and causing the axial slip joint 58 to substantially fully extend. The method may include an additional application of an axial pull force on the inner string assembly 40, thereby causing the stinger 52 to become released from the collar 38. In some embodiments, the additional application of an axial pull force on the inner string assembly 40 may cause the separable member 56 of the inner string assembly 40 to separate. The method may continue with removing the inner string assembly 40 from the wellbore 10. In embodiments in which the separable member 56 of the inner string assembly 40 separates, the stinger 52 and the separated part of the separable member 56 may be left in place. FIG. 14 illustrates the upper portion of the stage cementing assembly 22 in the wellbore 10 after removing the inner string assembly 40.

In some embodiments, the items of the inner string assembly 40 remaining in the wellbore 10 may be left in place. In some embodiments, the items of the inner string assembly 40 remaining in the wellbore 10 may be drilled through, milled through, or otherwise disintegrated in subsequent operations.

Additional Embodiments

The present disclosure provides, among others, the following embodiments, each of which may be considered as optionally including any alternative embodiments.

Embodiment 1. A stage cementing system, comprising: a stage cementing assembly having a stage tool, the stage tool comprising: an outer mandrel, an inner mandrel coupled to and disposed inside of the outer mandrel, an annular chamber between the outer mandrel and the inner mandrel, a first outer port through the outer mandrel, and longitudinally spaced first and second inner ports through the inner mandrel; and an inner string assembly configured to be located inside the inner mandrel, the inner string assembly comprising: a tubular body having a central throughbore and longitudinally spaced first and second side ports, a lower external seal element below the first and second side ports, a middle external seal element between the first and second side ports, and an upper external seal element above the first and second side ports.

Embodiment 2. The stage cementing system of Embodiment 1, wherein the stage tool further comprises a closing sleeve disposed in the annular chamber.

Embodiment 3. The stage cementing system of Embodiment 2, wherein the closing sleeve is movable between: a first position in which the closing sleeve permits fluid communication between an interior of the stage cementing assembly and an exterior of the stage cementing assembly through the first inner port and the first outer port, and a second position in which the closing sleeve prevents fluid communication between the interior of the stage cementing assembly and the exterior of the stage cementing assembly through the first inner port and the first outer port.

Embodiment 4. The stage cementing system of Embodiment 3, wherein the closing sleeve prevents fluid communication between the interior of the stage cementing assembly and the exterior of the stage cementing assembly through the second inner port and the first outer port when the closing sleeve is in both the first and the second positions.

Embodiment 5. The stage cementing system of Embodiment 2, wherein the closing sleeve is actuated to the second position by an application of hydraulic pressure through the second inner port.

Embodiment 6. The stage cementing system of Embodiment 1, wherein in use, the middle external seal element is located between the first and second inner ports of the stage tool.

Embodiment 7. The stage cementing system of Embodiment 6, wherein in use, the lower external seal element is located below the first and second inner ports of the stage tool.

Embodiment 8. The stage cementing system of Embodiment 7, wherein in use, the upper external seal element is located above the first and second inner ports of the stage tool.

Embodiment 9. The stage cementing system of Embodiment 1, wherein an interior of the inner mandrel does not include an internal movable sleeve.

Embodiment 10. The stage cementing system of Embodiment 1, wherein the stage tool further comprises a second outer port through the outer mandrel, the second outer port having a relief valve.

Embodiment 11. The stage cementing system of Embodiment 10, wherein the relief valve selectively permits fluid communication from an exterior of the stage cementing assembly to an interior of the stage cementing assembly through the second outer port, and prevents fluid communication from the interior of the stage cementing assembly to the exterior of the stage cementing assembly through the second outer port.

Embodiment 12. The stage cementing system of Embodiment 10, wherein the relief valve is a check valve.

Embodiment 13. The stage cementing system of Embodiment 1, wherein the stage tool further comprises a barrier member having a first configuration in which the barrier member prevents fluid communication between an interior of the stage cementing assembly and an exterior of the stage cementing assembly through the first outer port, and a second configuration in which the barrier member permits fluid communication between the interior of the stage cementing assembly and the exterior of the stage cementing assembly through the first outer port.

Embodiment 14. The stage cementing system of Embodiment 13, wherein the barrier member is a rupture disk.

Embodiment 15. The stage cementing system of Embodiment 1, wherein the stage cementing assembly further comprises a packer coupled to the stage tool.

Embodiment 16. The stage cementing system of Embodiment 15, further comprising a packer valve configured to selectively open to permit fluid communication between an interior of the stage cementing assembly and an internal chamber of the packer.

Embodiment 17. The stage cementing system of Embodiment 16, wherein the packer valve is configured to selectively close to prevent fluid communication between the interior of the stage cementing assembly and the internal chamber of the packer.

Embodiment 18. The stage cementing system of Embodiment 16, wherein the stage tool further comprises a barrier member having a first configuration in which the barrier member prevents fluid communication between the interior of the stage cementing assembly and the exterior of the stage cementing assembly through the first outer port, and a second configuration in which the barrier member permits fluid communication between the interior of the stage cementing assembly and the exterior of the stage cementing assembly through the first outer port.

Embodiment 19. The stage cementing system of Embodiment 18, wherein the barrier member is a rupture disk.

Embodiment 20. The stage cementing system of Embodiment 19, wherein the rupture disk is configured to break before the packer valve closes.

Embodiment 21. The stage cementing system of Embodiment 1, wherein the stage cementing assembly has an internal location profile.

Embodiment 22. The stage cementing system of Embodiment 21, wherein the inner string assembly has a locator configured for engagement with the internal location profile.

Embodiment 23. A stage cementing assembly comprising: a stage tool comprising: an outer mandrel, an inner mandrel immovably disposed inside and coupled to the outer mandrel, an annular chamber between the outer mandrel and the inner mandrel, a first outer port through the outer mandrel, longitudinally spaced first and second inner ports through the inner mandrel, and a closing sleeve disposed in the annular chamber, the closing sleeve movable between a first position in which the closing sleeve permits fluid communication between an interior of the stage cementing assembly and an exterior of the stage cementing assembly through the first inner port and the first outer port, and a second position in which the closing sleeve prevents fluid communication between the interior of the stage cementing assembly and the exterior of the stage cementing assembly through the first inner port and the first outer port; wherein the closing sleeve prevents fluid communication between the interior of the stage cementing assembly and the exterior of the stage cementing assembly through the second inner port and the first outer port when the sleeve is in both the first and the second positions; and wherein an interior of the inner mandrel does not include an internal movable sleeve.

Embodiment 24. The stage cementing assembly of Embodiment 23, wherein the closing sleeve is actuated to the second position by an application of hydraulic pressure through the second inner port.

Embodiment 25. The stage cementing assembly of Embodiment 23, further comprising a second outer port through the outer mandrel, the second outer port having a relief valve.

Embodiment 26. The stage cementing assembly of Embodiment 25, wherein the relief valve selectively permits fluid communication from the exterior of the stage cementing assembly to the interior of the stage cementing assembly through the second outer port, and prevents fluid communication from the interior of the stage cementing assembly to the exterior of the stage cementing assembly through the second outer port.

Embodiment 27. The stage cementing assembly of Embodiment 23, further comprising a barrier member having a first configuration in which the barrier member prevents fluid communication between the interior of the stage cementing assembly and the exterior of the stage cementing assembly through the first outer port, and a second configuration in which the barrier member permits fluid communication between the interior of the stage cementing assembly and the exterior of the stage cementing assembly through the first outer port.

Embodiment 28. The stage cementing assembly of Embodiment 23, wherein the barrier member is a rupture disk.

Embodiment 29. The stage cementing assembly of Embodiment 27, further comprising a packer below the first outer port.

Embodiment 30. The stage cementing assembly of Embodiment 29, further comprising a packer valve configured to selectively open to permit fluid communication between the interior of the stage cementing assembly and an internal chamber of the packer.

Embodiment 31. The stage cementing assembly of Embodiment 30, wherein the packer valve is configured to selectively close to prevent fluid communication between the interior of the stage cementing assembly and the internal chamber of the packer.

Embodiment 32. The stage cementing assembly of Embodiment 30, wherein the barrier member is a rupture disk configured to break before the packer valve closes.

Embodiment 33. The stage cementing assembly of Embodiment 30, wherein the barrier member is a rupture disk configured to break when the packer valve closes.

Embodiment 34. The stage cementing assembly of Embodiment 30, wherein the barrier member is a rupture disk configured to break after the packer valve closes.

Embodiment 35. The stage cementing assembly of Embodiment 23, further comprising an internal location profile.

Embodiment 36. The stage cementing assembly of Embodiment 35, wherein the internal location profile is configured for engagement with a corresponding locator of an inner string.

Embodiment 37. A stage tool comprising: an outer mandrel; an inner mandrel immovably disposed inside and coupled to the outer mandrel; an annular chamber between the outer mandrel and the inner mandrel; a first outer port through the outer mandrel; a second outer port through the outer mandrel, the second outer port having a relief valve; longitudinally spaced first and second inner ports through the inner mandrel; a barrier member having a first configuration in which the barrier member prevents fluid communication between an interior of the stage tool and an exterior of the stage tool through the first outer port, and a second configuration in which the barrier member permits fluid communication between the interior of the stage tool and the exterior of the stage tool through the first outer port; a closing sleeve disposed in the annular chamber, the closing sleeve movable between a first position in which the closing sleeve permits fluid communication between the interior of the stage tool and the exterior of the stage tool through the first inner port and the first outer port, and a second position in which the closing sleeve prevents fluid communication between the interior of the stage tool and the exterior of the stage tool through the first inner port and the first outer port; wherein the closing sleeve prevents fluid communication between the interior of the stage tool and the exterior of the stage tool through the second inner port and the first outer port when the sleeve is in both the first and the second positions.

Embodiment 38. The stage tool of Embodiment 37, wherein the relief valve selectively permits fluid communication from the exterior of the stage tool to the interior of the stage tool through the second outer port, and prevents fluid communication from the interior of the stage tool to the exterior of the stage tool through the second outer port.

Embodiment 39. The stage tool of Embodiment 37, wherein the barrier member is a rupture disk.

Embodiment 40. The stage tool of Embodiment 37, further comprising an internal location profile.

Embodiment 41. The stage tool of Embodiment 40, wherein the internal location profile is configured for engagement with a corresponding locator of an inner string.

Embodiment 42. A tool for use in cementing a casing, the tool comprising: a tubular body having a central throughbore and longitudinally spaced first and second side ports; a lower external seal element below the first and second side ports; a middle external seal element between the first and second side ports; and an upper external seal element above the first and second side ports.

Embodiment 43. The tool of Embodiment 42, wherein the lower external seal element defines an upper boundary of a first annular compartment surrounding the tubular body.

Embodiment 44. The tool of Embodiment 43, wherein the lower external seal element and the middle external seal element define respective lower and upper boundaries of a second annular compartment surrounding the tubular body.

Embodiment 45. The tool of Embodiment 44, wherein the middle external seal element and the upper external seal element define respective lower and upper boundaries of a third annular compartment surrounding the tubular body.

Embodiment 46. The tool of Embodiment 45, wherein the upper external seal element defines a lower boundary of a fourth annular compartment surrounding the tubular body.

Embodiment 47. The tool of Embodiment 46, further comprising a bypass fluidly connecting the first and fourth annular compartments.

Embodiment 48. The tool of Embodiment 47, further comprising a relief port fluidly connecting the third annular compartment with the bypass.

Embodiment 49. The tool of Embodiment 48, further comprising a relief valve associated with the relief port, the relief valve configured to permit fluid flow from the bypass into the third annular compartment, and prevent fluid flow from the third annular compartment into the bypass.

Embodiment 50. The tool of Embodiment 42, further comprising a locator configured for engagement with a corresponding internal location profile associated with a stage cementing assembly.

Embodiment 51. The tool of Embodiment 42, further comprising a first sleeve having a first position in which the first sleeve prevents fluid communication through the first side port and a second position in which the first sleeve permits fluid communication through the first side port.

Embodiment 52. The tool of Embodiment 51, further comprising a second sleeve having a first position in which the second sleeve prevents fluid communication through the second side port and a second position in which the second sleeve permits fluid communication through the second side port.

Embodiment 53. The tool of Embodiment 52, further comprising a time-delay releasable seat below the first sleeve.

Embodiment 54. The tool of Embodiment 52, further comprising a dart catcher below the first sleeve, the dart catcher having a fluid bypass.

Embodiment 55. The tool of Embodiment 42, further comprising a stinger below the lower external seal element, the stinger having a stinger seal configured to sealingly engage a seal receptacle of a surrounding casing.

Embodiment 56. The tool of Embodiment 55, wherein the stinger is configured to latch into the seal receptacle of the surrounding casing.

Embodiment 57. The tool of Embodiment 55, further comprising a slip joint above the stinger.

Embodiment 58. The tool of Embodiment 57, further comprising a releasable connection between the slip joint and the stinger.

Embodiment 59. The tool of Embodiment 55, further comprising a circulation port fluidly connecting the central throughbore with an exterior of the tubular body through a sidewall of the tubular body.

Embodiment 60. The tool of Embodiment 59, wherein the circulation port has a closed configuration and an open configuration.

Embodiment 61. The tool of Embodiment 60, wherein the circulation port has a rupture disk, and wherein when the rupture disk is intact, the circulation port is in the closed configuration, and when the rupture disk is defeated, the circulation port is in the open configuration.

Embodiment 62. A method of cementing a casing string including a stage tool, the method comprising: opening a first side port of an inner string located inside the casing string; pumping a cementing fluid through the first side port, into a first annular space between the inner string and the casing string, through a first inner port of an inner mandrel of the stage tool, and a first outer port of an outer mandrel of the stage tool; then opening a second side port of the inner string; and applying a hydraulic pressure through the second side port into a second annular space between the inner string and the casing string, and through a second inner port of the inner mandrel of the stage tool, thereby moving a closing sleeve of the stage tool to a position preventing fluid flow through the first outer port.

Embodiment 63. The method of Embodiment 62, further comprising engaging a locator of the inner string with an internal location profile of the casing string.

Embodiment 64. The method of Embodiment 62, further comprising setting a packer coupled to the stage tool after opening the first side port and before causing the cementing fluid to flow through the first outer port of the outer mandrel of the stage tool.

Embodiment 65. The method of Embodiment 62, further comprising defeating a barrier member before causing the cementing fluid to flow through the first outer port of the outer mandrel of the stage tool.

Embodiment 66. The method of Embodiment 65, wherein defeating the barrier member comprises rupturing a disk associated with the first outer port of the outer mandrel of the stage tool.

Embodiment 67. The method of Embodiment 62, further comprising applying a test pressure to the stage tool after moving the closing sleeve of the stage tool to the position preventing fluid flow through the first outer port.

Embodiment 68. The method of Embodiment 62, wherein opening the first side port further comprises landing a first actuation object in a first seat associated with the first side port, and applying a first opening pressure to the first actuation object.

Embodiment 69. The method of Embodiment 68, wherein opening the second side port further comprises landing a second actuation object in a second seat associated with the second side port, and applying a second opening pressure to the second actuation object.

Embodiment 70. The method of Embodiment 69, further comprising displacing the first and second actuating objects to a time-delay releasable seat after moving the closing sleeve of the stage tool to the position preventing fluid flow through the first outer port and before pressure testing the stage tool.

Embodiment 71. The method of Embodiment 70, further comprising applying the test pressure to the second actuating object, thereby moving a sleeve of the time-delay releasable seat from a seat-retaining position to a seat-releasing position.

Embodiment 72. The method of Embodiment 71, wherein the sleeve of the time-delay releasable seat includes an outward radial projection having a fluid transfer bore, and moving the sleeve of the time-delay releasable seat causes a fluid to flow through the fluid transfer bore.

Embodiment 73. The method of Embodiment 72, wherein the fluid transfer bore has a restriction hindering the flow of fluid through the fluid transfer bore.

Embodiment 74. The method of Embodiment 71, further comprising causing the first and second actuating objects to move to a catcher after the sleeve of the time-delay releasable seat moves to the seat-releasing position.

Embodiment 75. The method of Embodiment 67, further comprising applying an upward axial force to the inner string after applying the test pressure to the stage tool, thereby separating an upper portion of the inner string from a lower portion of the inner string.

Embodiment 76. The method of any of Embodiments 62 to 75, further comprising retrieving the inner string from the casing string.

While the foregoing is directed to embodiments of the present disclosure, other and further embodiments of the disclosure may be devised without departing from the basic scope thereof, and the scope thereof is determined by the claims that follow.

What is claimed is:

1. A stage cementing system, comprising:

a stage cementing assembly having a stage tool, the stage tool comprising:

an outer mandrel, an inner mandrel coupled to and disposed inside of the outer mandrel, an annular chamber between the outer mandrel and the inner mandrel, a first outer port through the outer mandrel, and longitudinally spaced first and second inner ports through the inner mandrel; and an inner string assembly configured to be located inside the inner mandrel, the inner string assembly comprising:

a tubular body having a central throughbore and longitudinally spaced first and second side ports, a lower external seal element below the first and second side ports, a middle external seal element between the first and second side ports, an upper external seal element above the first and second side ports, and a bypass configured to fluidically connect a first zone below the lower external seal element with a second zone above the upper external seal element.

2. The stage cementing system of claim 1, wherein the stage tool further comprises a closing sleeve disposed in the annular chamber, the closing sleeve movable between:

a first position in which the closing sleeve permits fluid communication between an interior of the stage cementing assembly and an exterior of the stage cementing assembly through the first inner port and the first outer port, and a second position in which the closing sleeve prevents fluid communication between the interior of the stage cementing assembly and the exterior of the stage cementing assembly through the first inner port and the first outer port.

3. The stage cementing system of claim 2, wherein the closing sleeve is actuated to the second position by an application of hydraulic pressure through the second inner port.

4. The stage cementing system of claim 1, wherein in use:

the middle external seal element is located between the first and second inner ports of the stage tool;

the lower external seal element is located below the first and second inner ports of the stage tool; and the upper external seal element is located above the first and second inner ports of the stage tool.

5. The stage cementing system of claim 4, wherein the lower, middle, and upper external seal elements contact an inner wall of the inner mandrel.

6. The stage cementing system of claim 1, wherein an interior of the inner mandrel does not include an internal movable sleeve.

7. The stage cementing system of claim 1, wherein the stage tool further comprises a second outer port through the outer mandrel, the second outer port having a relief valve.

8. The stage cementing system of claim 1, wherein the stage cementing assembly further comprises a packer coupled to the stage tool.

9. The stage cementing system of claim 1, wherein the stage cementing assembly has an internal location profile configured for engagement with a locator of the inner string assembly.

10. The stage cementing system of claim 1, wherein the inner string assembly includes a relief port configured to fluidically connect a third zone between the upper and middle external seal elements with the bypass.

11. A method of cementing a casing string including a stage tool, the method comprising:

pumping a first fluid through an inner string located inside the casing string, into a first annular space below the stage tool, and through a bypass of the inner string into a second annular space above the stage tool;

then opening a first side port of the inner string;

pumping a cementing second fluid through the first side port, into a third annular space between the inner string and the casing string, through a first inner port of an inner mandrel of the stage tool, and a first outer port of an outer mandrel of the stage tool;

then opening a second side port of the inner string; and applying a hydraulic pressure through the second side port into a fourth annular space between the inner string and the casing string, and through a second inner port of the inner mandrel of the stage tool, thereby moving a closing sleeve of the stage tool to a position preventing fluid flow through the first outer port.

12. The method of claim 11, further comprising engaging a locator of the inner string with an internal location profile of the casing string.

13. The method of claim 11, further comprising setting a packer coupled to the stage tool after opening the first side port and before causing the cementing second fluid to flow through the first outer port of the outer mandrel of the stage tool.

14. The method of claim 11, further comprising defeating a barrier member before causing the cementing second fluid to flow through the first outer port of the outer mandrel of the stage tool.

15. The method of claim 11, further comprising applying a test pressure to the stage tool after moving the closing sleeve of the stage tool to the position preventing fluid flow through the first outer port.

16. The method of claim 11, wherein:

opening the first side port further comprises landing a first actuating object in a first seat associated with the first side port, and applying a first opening pressure to the first actuating object;

opening the second side port further comprises landing a second actuating object in a second seat associated with the second side port, and applying a second opening pressure to the second actuating object; and displacing the first and second actuating objects to a time-delay releasable seat after moving the closing sleeve of the stage tool to the position preventing fluid flow through the first outer port, and before pressure testing the stage tool by applying a test pressure via the inner string.

17. The method of claim 16, further comprising:

applying the test pressure to the second actuating object, thereby moving a sleeve of the time-delay releasable seat from a seat-retaining position to a seat-releasing position; and then causing the first and second actuating objects to move to a catcher.

18. The method of claim 11, further comprising retrieving the inner string from the casing string.

19. The method of claim 11, further comprising:

opening a circulation port of the inner string prior to pumping the first fluid into the first annular space.

* * * * *